US012371966B1

(12) United States Patent
Davis

(10) Patent No.: US 12,371,966 B1
(45) Date of Patent: Jul. 29, 2025

(54) SLIP RETENTION MECHANISM FOR DOWNHOLE ISOLATION DEVICE

(71) Applicant: Halliburton Energy Services, Inc., Houston, TX (US)

(72) Inventor: Kyle Wayne Davis, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 18/663,612

(22) Filed: May 14, 2024

(51) Int. Cl.
*E21B 33/129* (2006.01)

(52) U.S. Cl.
CPC ..... *E21B 33/1292* (2013.01)

(58) Field of Classification Search
CPC ..... E21B 33/129; E21B 33/1291; E21B 33/1292; E21B 33/1293; E21B 33/1294; E21B 33/12955
See application file for complete search history.

(56) References Cited

U.S. PATENT DOCUMENTS 3,229,767 A * 1/1966 Carter ..... E21B 33/1293 166/134
3,623,551 A * 11/1971 Randermann, Jr. ..... E21B 33/1293 166/134
9,926,765 B2 * 3/2018 Goodman ..... E21B 33/128
12,188,314 B1 * 1/2025 Blott ..... E21B 33/129
2016/0061001 A1 * 3/2016 Fitzhugh ..... E21B 23/06 166/135
2017/0268310 A1 9/2017 Shkurti et al.
2018/0171744 A1 * 6/2018 Markel ..... E21B 23/01
2018/0171746 A1 6/2018 Dudzinski et al.
2018/0298708 A1 * 10/2018 Schmidt ..... E21B 33/1291
2020/0141207 A1 5/2020 Smith et al.
2021/0054704 A1 2/2021 Merron et al.
2021/0062597 A1 * 3/2021 Yuan ..... E21B 21/10
2021/0293112 A1 9/2021 Smith
2023/0026973 A1 1/2023 Milne

FOREIGN PATENT DOCUMENTS

CN 216922077 U 7/2022

OTHER PUBLICATIONS

CN216922077U Translation (Year: 2025).*
Foreign Communication from Related Application—International Search Report and Written Opinion of the International Searching Authority, International Application No. PCT/US2024/033505, dated Feb. 10, 2025, 10 pages.

* cited by examiner

*Primary Examiner* — Giovanna Wright
(74) *Attorney, Agent, or Firm* — Conley Rose, P.C.; Rodney B. Carroll

(57) ABSTRACT

Disclosed embodiments relate to isolation devices for use downhole in a wellbore, for example to isolate a zone of a well. Isolation device embodiments may include a slip, a wedge, a seal element, and a retaining mechanism. The slip may have a run-in position with respect to the wedge and a set position with respect to the wedge. The seal element may be configured to expand radially during movement from the run-in position to the set position. The retaining mechanism may be configured to allow movement of the slip from the run-in position towards the set position, but to lock the slip in the set position. In embodiments, the retaining mechanism may be configured to prevent dislocation of the slip when set, for example forming a retaining cage around the slip.

20 Claims, 14 Drawing Sheets

SLIP RETENTION MECHANISM FOR DOWNHOLE ISOLATION DEVICE

FIELD

The present disclosure relates generally to an isolation device, for example for use in a wellbore, and more particularly, to isolation devices configured to minimize dislocation of a slip.

BACKGROUND

Wellbores may be drilled into the earth for a variety of purposes, including accessing hydrocarbon bearing formations. A variety of downhole tools may be used within a wellbore in connection with accessing and extracting such hydrocarbons. Throughout the process, it may become necessary to isolate sections of the wellbore in order to create pressure zones. Downhole isolation tools, such as hydraulic fracturing ("frac") plugs, bridge plugs, packers, and other suitable tools, may be used to isolate wellbore sections.

Downhole isolation tools, such as frac plugs, can commonly be run into the wellbore on a conveyance such as a wireline, work string or production tubing. For example, a downhole isolation tool can be run into a wellbore (e.g. as part of a tool string) while in a first, unexpanded (e.g. run-in) state, and then radially expanded into a second, expanded (e.g. set) state. In the first state, the downhole isolation tool may have a smaller outer diameter than the larger (expanded) outer diameter in the second state. Once set in place, the downhole isolation tool may be configured to seal off the flow of liquid around the exterior of the downhole isolation tool. In some instances, the downhole isolation tool can allow fluid communication between sections of the wellbore above the plug and below the plug (e.g. with fluid communication through the plug, for example through a bore therethrough), for example until another downhole tool (e.g. configured for use with the downhole isolation tool), such as a ball, is pumped down to seat in the plug and interrupt fluid communication through the plug.

BRIEF DESCRIPTION OF THE DRAWINGS

Embodiments of the disclosure may be better understood by referencing the accompanying drawings.

DESCRIPTION

Figure 1:
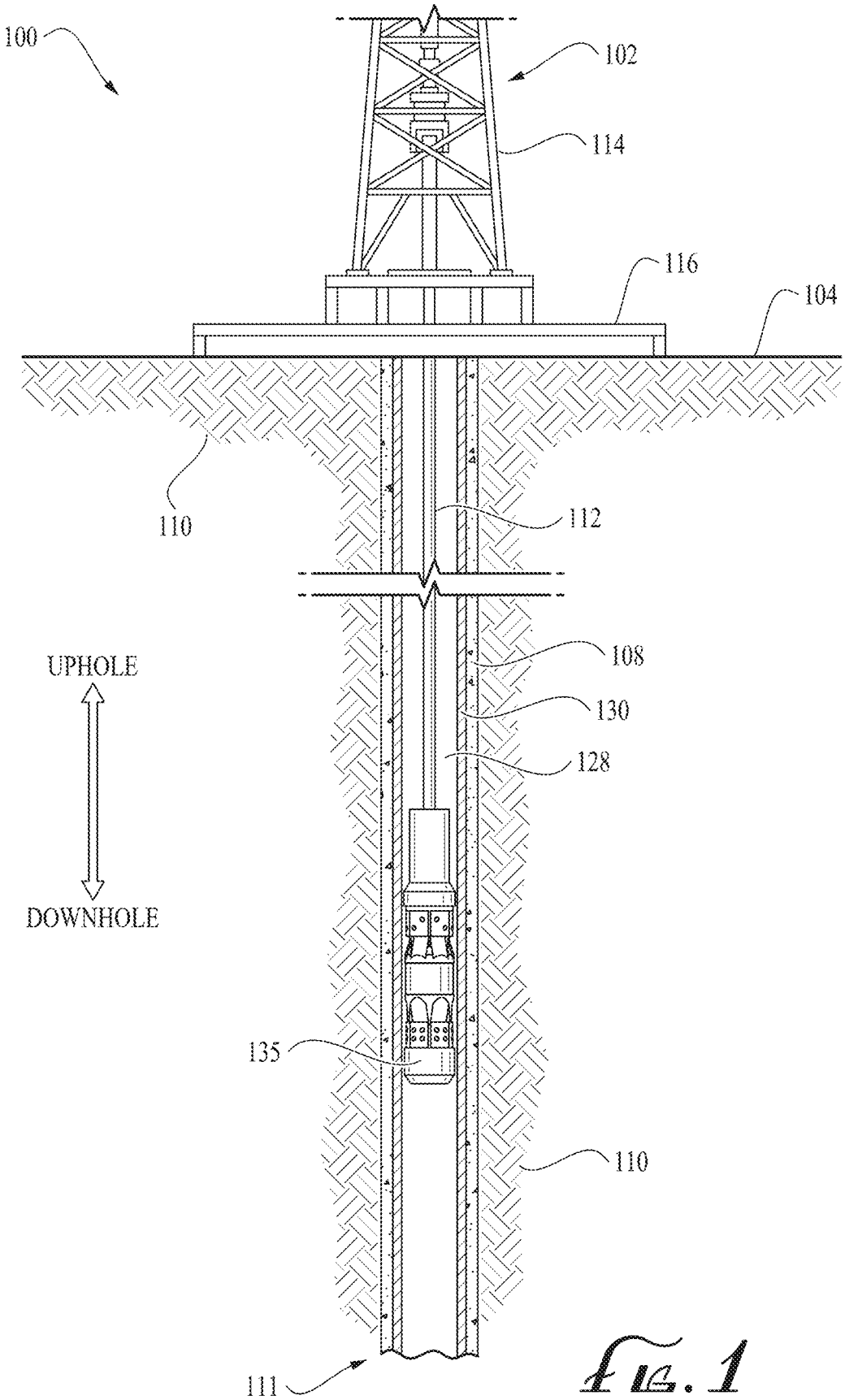
FIG. 1 illustrates a schematic elevation view of an exemplary well in which an exemplary isolation device is being run downhole, according to embodiments of this disclosure.

The description that follows includes example systems, methods, techniques, and program flows that embody aspects of the disclosure. However, it is understood that this disclosure may be practiced without these specific details. For brevity, well-known steps, protocols, structures, and techniques have not been shown in detail in order not to obfuscate the description.

As used herein the terms "uphole", "upwell", "above", "top", and the like refer directionally in a wellbore towards the surface, while the terms "downhole", "downwell", "below", "bottom", and the like refer directionally in a wellbore towards the toe of the wellbore (e.g. the end of the wellbore distally away from the surface), as persons of skill will understand.

Oil and gas hydrocarbons are naturally occurring in some subterranean formations. In the oil and gas industry, a subterranean formation containing oil and/or gas can be referred to as a reservoir. A reservoir can be located under land or offshore. Reservoirs are typically located in the range of a few hundred feet (shallow reservoirs) to a few tens of thousands of feet (ultra-deep reservoirs). In order to produce oil or gas, a wellbore may be drilled into a reservoir or adjacent to a reservoir. The oil, gas, or water produced from a reservoir is called a reservoir fluid.

As used herein, a "fluid" is a substance having a continuous phase that can flow and conform to the outline of its container when the substance is tested at a temperature of 71° F. (22° C.) and a pressure of one atmosphere "atm" (0.1 megapascals "MPa"). A fluid can be a liquid or gas. A homogenous fluid has only one phase, whereas a heterogeneous fluid has more than one distinct phase.

A well can include, without limitation, an oil, gas, or water production well, an injection well, or a geothermal well. As used herein, a "well" includes at least one wellbore.

A wellbore can include vertical, inclined, and/or horizontal portions, and it can be straight, curved, or branched. As used herein, the term "wellbore" includes any cased, and any uncased, open-hole portion of the wellbore. A near-wellbore region is the subterranean material and rock of the subterranean formation surrounding the wellbore. As used herein, a "well" also includes the near-wellbore region. The near-wellbore region is generally considered to be the region within approximately 100 feet radially of the wellbore. As used herein, "into a subterranean formation" means and includes into any portion of the well, including into the wellbore, into the near-wellbore region via the wellbore, or into the subterranean formation via the wellbore.

In embodiments, a portion of a wellbore can be an open hole or a cased hole. In an open-hole wellbore portion, a tubing string can be placed into the wellbore. The tubing string allows fluids to be introduced into or flowed from a remote portion of the wellbore. In a cased-hole wellbore portion, a casing is placed into the wellbore that can also contain a tubing string. A wellbore can contain an annulus. Examples of an annulus include, but are not limited to: the space between the wellbore and the outside of a tubing string in an open-hole wellbore; the space between the wellbore and the outside of a casing in a cased-hole wellbore; and the space between the inside of a casing and the outside of a tubing string in a cased-hole wellbore.

It is not uncommon for a wellbore to extend several hundreds of feet or several thousands of feet into a subterranean formation. The subterranean formation can have different zones. A zone is an interval of rock differentiated from surrounding rocks on the basis of its fossil content or other features, such as faults or fractures. For example, one zone can have a higher permeability compared to another zone. It is often desirable to treat one or more locations within multiples zones of a formation. One or more zones of the formation can be isolated within the wellbore via the use of an isolation device to create multiple wellbore intervals (which may also be termed zones). At least one wellbore interval can correspond to a formation zone. Disclosed isolation devices can be used for zonal isolation and can function to block fluid flow within a tubular section, such as a tubing string, or within an annulus. The blockage of fluid flow can prevent the fluid from flowing across the isolation device in any direction and isolates the zone of interest. In this manner, treatment techniques, such as fracturing operations, can be performed within the zone of interest.

Common isolation devices include, but are not limited to, a ball and a seat, a bridge plug, a packer, a plug, a frac plug, and a wiper plug. It is to be understood that reference to a "ball" is not meant to limit the geometric shape of the ball to spherical, but rather is meant to include any device that is capable of engaging with a seat. A "ball" can be spherical in shape, but can also be a dart, a bar, or any other shape. Zonal isolation can be accomplished by dropping or flowing a ball from the wellhead onto a seat that is located within the wellbore, for example as a part of a downhole isolation tool. The ball can engage with the seat, and the seal created by this engagement may prevent fluid communication into other wellbore intervals downstream or downhole of the ball and seat. As used herein, the relative term "downstream" means at a location further away from a wellhead.

Plugs, for example, frac plugs, generally can include slips, wedges, an inner plug mandrel, a spacer ring, a mule shoe, and a rubber sealing element. The plug can also include a setting device and an additional mandrel, such as a tension mandrel or setting mandrel. The plug can be introduced into the wellbore and positioned at a desired location within a tubing string. The "tubing string" can also be a casing in some embodiments. The plug can be set after being placed at the desired location. As used herein, the term "set" and all grammatical variations means one or more components of the plug are actuated to keep the plug at the desired location and substantially diminish or restrict fluid flow past the outside of the plug. For example, the isolation device (e.g. plug) can be mechanically actuated to move a top slip into engagement with the inner diameter (I.D.) of the tubing string. A mule shoe, which is typically pinned and/or threaded to a (e.g. removable) inner plug mandrel, can also be mechanically actuated to move a bottom slip into engagement with the I.D. of the tubing string. Movement of the top and bottom slips can cause top and bottom wedges to mechanically actuate the rubber sealing element to expand and engage with the I.D. of the tubing string. This expansion of the rubber sealing element creates zonal isolation by substantially diminishing or restricting fluid flow around the outside of the plug. A ball can then be seated onto the plug whereby after being seated, the ball restricts fluid flow through the isolation device.

However, during high rate pumping of fluid for example, the top slip of the isolation device (e.g. plug) may be prone to dislocating and becoming an impediment to the inner diameter of the plug. For example, top slip impediment may block the ball seat of the plug, which may prevent effective (e.g. sealing) seating of a ball dropped with the intent of closing the bore through the plug (e.g. preventing effective landing of the ball on the seat).

Disclosed embodiments are configured to address such dislocation concerns. For example, disclosed embodiments may include a retaining mechanism configured to prevent dislocation of the top slip when set. The isolation device (e.g. plug) can include a seal element that can be actuated to engage with an I.D. of a tubing string (e.g. wellbore) to set the plug. Top and bottom wedges (e.g. slip props) of the plug can be self-supporting and can be shaped such that the seal element is inhibited or prevented from engaging with the removable inner mandrel. Thus, the wedges may not require the inner mandrel for support, with the inner mandrel being removable from the plug after setting (and possibly reusable in other downhole tools). The top slip may be configured to engage the top wedge as it moves from unset to set position. The retaining mechanism can be configured to trap/lock the top slip in its set position, for example locking onto the top wedge (e.g. locking to the outer surface of the top wedge) and/or forming a cage around the top slip configured to prevent dislocation (for example, with the top slip held between and/or by positive contact with the retaining mechanism and the top wedge). The retaining mechanism may be configured to allow movement of the top slip from the run-in position towards the set position (e.g. downhole movement), but to prevent movement of the top slip away from the set position (e.g. locking the top slip in the set position and/or against uphole movement—e.g. preventing axial movement that would allow axial separation of the slip from the wedge). The retaining mechanism may be configured to follow along with the top slip as it moves along the top wedge during setting, for example not impeding movement up the top wedge (e.g. towards set position) and/or maintaining positive contact throughout the movement, but preventing movement down the top wedge (e.g. towards the unset position). In some embodiments, the retaining mechanism may include a ratchet system and/or a latching mechanism.

In embodiments, the plug can be used for zonal isolation to treat a zone of interest within a subterranean formation.

The treatment can, for example, be a fracturing operation. The fracturing operation can include introducing a fracturing fluid into the zone to be treated, wherein the fracturing fluid creates or enhances one or more fractures in the subterranean formation.

As used herein, the terms "run into" and "run in" mean that the isolation device (e.g. plug) is capable of being moved within a tubing string to a desired location and/or the time during which the isolation device is being introduced into a wellbore at a desired location. In embodiments, the isolation device can be a plug. The plug can be used in an oil and gas operation, such as a fracturing operation or for zonal isolation. The isolation device can be a frac plug, bridge plug, or zonal isolation plug. There can also be more than one isolation device that is run into a tubing or casing string (e.g. wellbore) to provide zonal isolation.

FIG. 1 illustrates a schematic, elevation view of an exemplary embodiment of a tool string 112 disposed within an exemplary well, with an isolation device 135 (such as a frac plug). While the operating environment is shown in FIG. 1 with respect to a stationary, land-based rig for raising, lowering, and setting a tool string 112 and/or isolation device 135, in alternative embodiments, mobile rigs, wellbore servicing units (e.g., coiled tubing units, slickline units, or wireline units), and the like may be used to lower the tool string 112. Furthermore, while the operating environment is generally discussed as relating to a land-based well, the systems and methods described herein may instead be operated in subsea well configurations, for example accessed by a fixed or floating offshore platform, drill ships, semi-submersibles, and/or drilling barges. Additionally, while wellbore 108 is shown as being a generally vertical wellbore, wellbore 108 may be or include any orientation, including generally horizontal, multilateral, or angularly directional.

FIG. 1, illustrates a production system 100 that includes a rig 102 atop a surface 104 of a well. Beneath the rig 102, a wellbore 108 is formed within a geological formation 110, which may be expected to produce hydrocarbons or other fluids. The wellbore 108 may be formed in the geological formation 110 using a drill string that includes a drill bit to remove material from the geological formation 110. The wellbore 108 of FIG. 1 is shown as being near-vertical, but may for example be formed at any suitable angle to reach a hydrocarbon-rich portion of the geological formation 110. In some embodiments, the wellbore 108 may follow a vertical, partially-vertical, angled, or even a partially-horizontal path through the geological formation 110, extending from the surface 104 to an exemplary toe 111.

In FIG. 1, a tool string 112 is deployed from the rig 102, which may be a drilling rig, a completion rig, a workover rig, or another type of rig. The rig 102 can include a derrick 114 and a rig floor 116. The tool string 112 in FIG. 1 extends downward through the rig floor 116, for example in some embodiments through a fluid diverter and blowout preventer (which may be configured as or include a nipple in some embodiments) that provide a fluidly sealed interface between the wellbore 108 and external environment, and into the wellbore 108 and geological formation 110. The tool string 112 is shown in deployment position in FIG. 1, for example in preparation for setting of the isolation device 135 (which is in run-in state in FIG. 1). In embodiments, prior to or following installation, the production system 100 may also include a motorized winch and other equipment for extending the tool string 112 into the wellbore 108, retrieving the tool string 112 from the wellbore 108, positioning the tool string 112 at a selected depth within the wellbore 108, or for lowering diagnostic, repair, or other equipment into the tool string 112 by (for example) wireline or slickline.

In some embodiments, a pump can be coupled the well and/or tool string 112, for example via a fluid diverter. The pump may be operational to deliver or receive fluid through a fluid bore (e.g. longitudinal bore) of the production tool string 112 by applying a positive or negative pressure to the fluid bore. The pump can be disposed at the surface 104 and/or, in some embodiments, within the wellbore 108. For example, an electrical submersible pump (ESP) may be included in the tool string 112. As referenced herein, the fluid bore is the flow path of fluid from an inlet of the production tool string 112 to the surface 104. The pump may also deliver positive or negative pressure through an annulus 128 formed between the wall of the wellbore 108 and exterior of the production tool string 112. In FIG. 1, the annulus 128 is formed between the production tool string 112 and a wellbore casing 130 when production tool string 112 is disposed within the wellbore 108. As referenced herein, the term "casing" may be used interchangeably with the term "liner" to indicate tubing that is used to line or otherwise provide a barrier along a wellbore wall. Such casings may be fabricated from composites, metals, plastics, or any other suitable material. As used herein, wellbore may encompass both cased and uncased wellbores.

Following formation of the wellbore 108, the tool string 112 may be equipped with tools and deployed within the wellbore 108 to prepare, operate, or maintain the well 106. Typically, the tool string 112 may be conveyed/deployed into the wellbore 108 and thereby moved and positioned downhole within the wellbore 108 by a conveyance mechanism. For example, the conveyance mechanism may be drill pipe extending downhole in some embodiments, or alternatively, coiled tubing or a wireline. The tool string 112 may incorporate tools that can be actuated after deployment in the wellbore 108, including without limitation an isolation device 135 (such as a frac plug). The isolation device 135 generally remains in the first (e.g. run-in) state as it is run into the wellbore 108 for installation and until the isolation device 135 is actuated and set within the wellbore 108. Upon actuation, the expandable seal element of the isolation device 135 extends radially (e.g. to the second, set state), for example to engage and form a seal against the well casing or wellbore wall.

Figure 2:
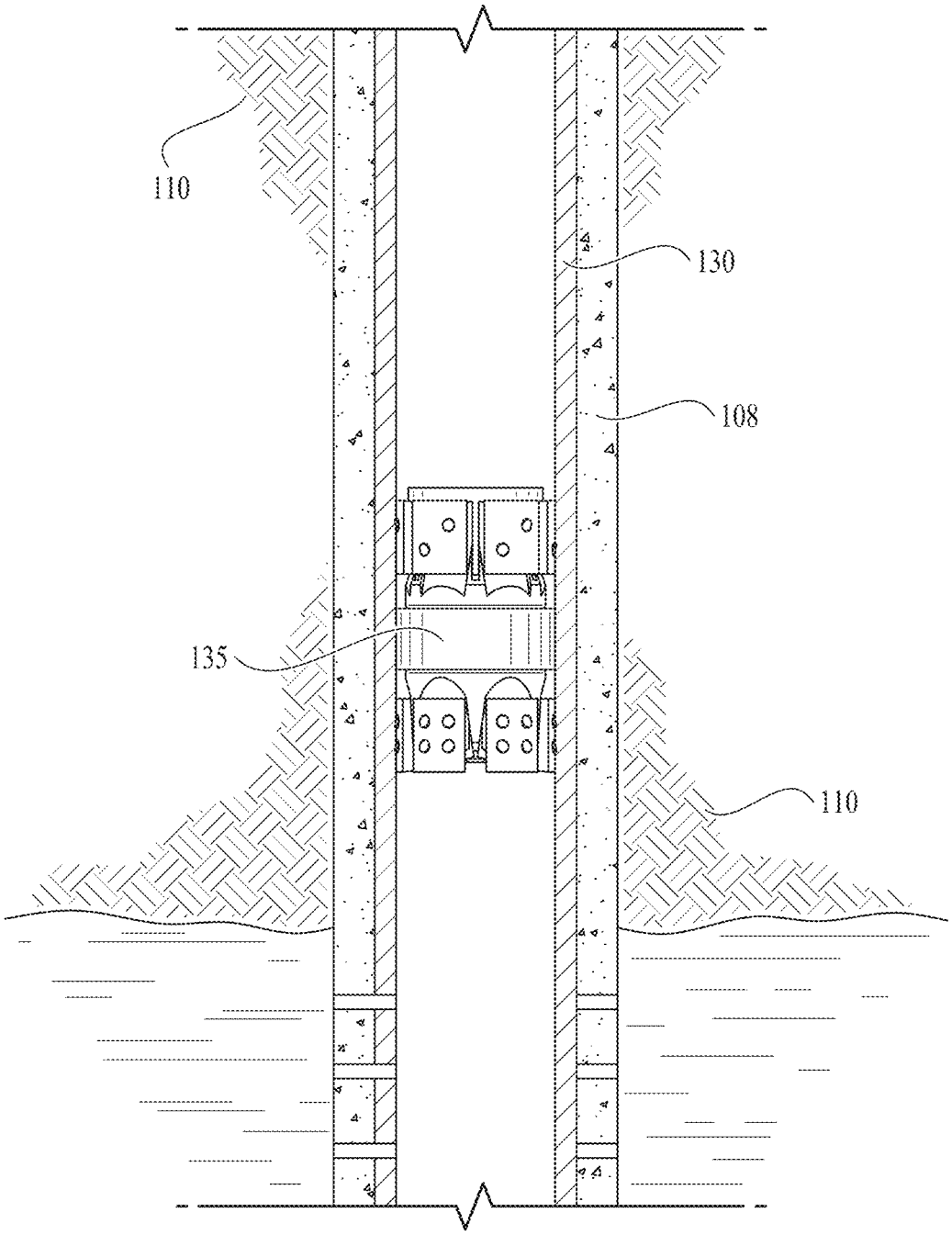
FIG. 2 schematically illustrates the well of FIG. 1 with the isolation device deployed/set therein, according to embodiments of this disclosure.

Once the isolation device 135 is set, the conveyance mechanism can be used to remove the setting device (and in some embodiments the mandrel, as discussed below), leaving the isolation device 135 in place within the wellbore. FIG. 2 illustrates such a set isolation device 135 within an exemplary wellbore 108.

Figure 3:
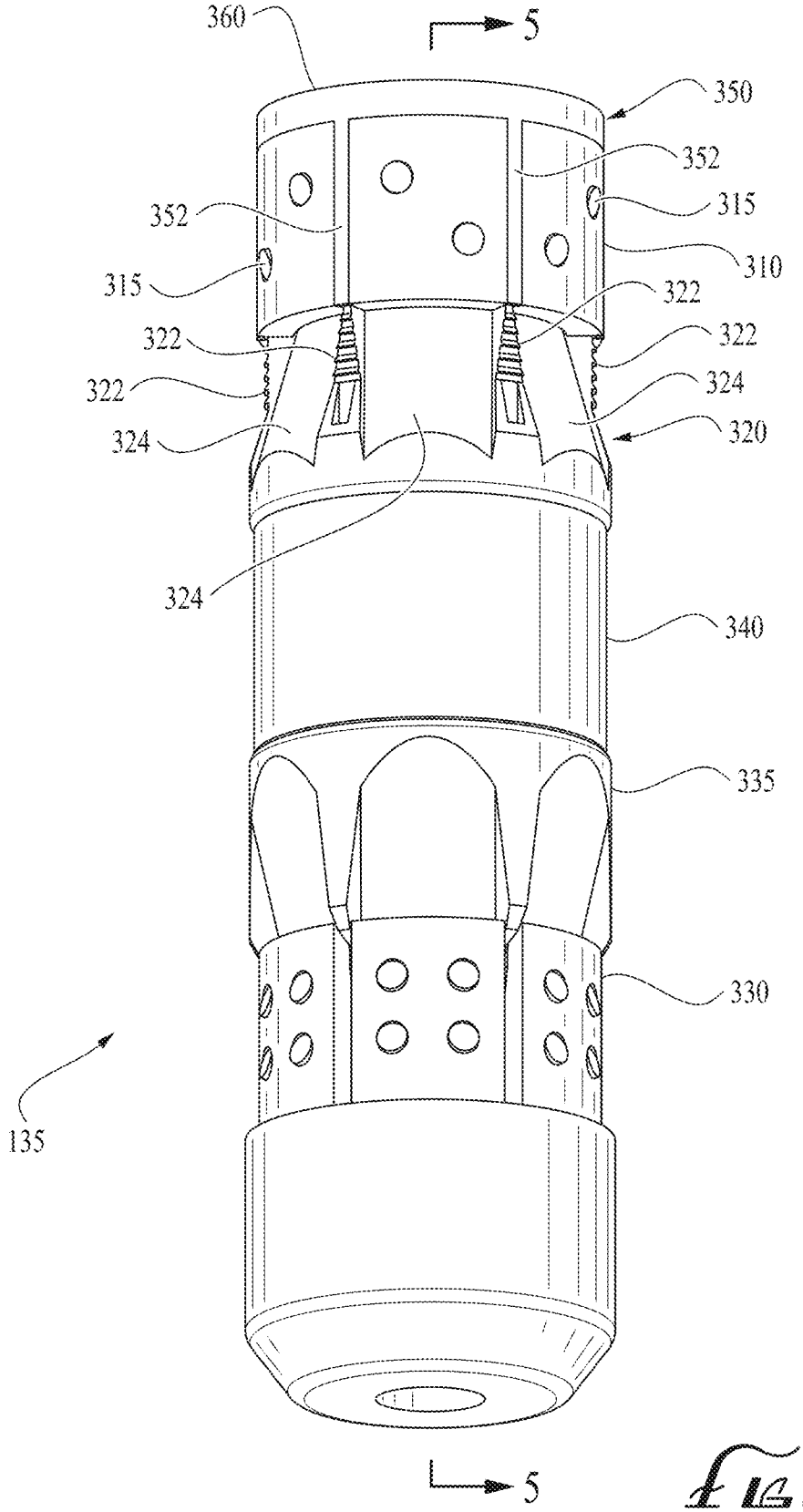
FIG. 3 provides an isometric view of an exemplary isolation device in its run-in state, according to embodiments of this disclosure.
Figure 4:
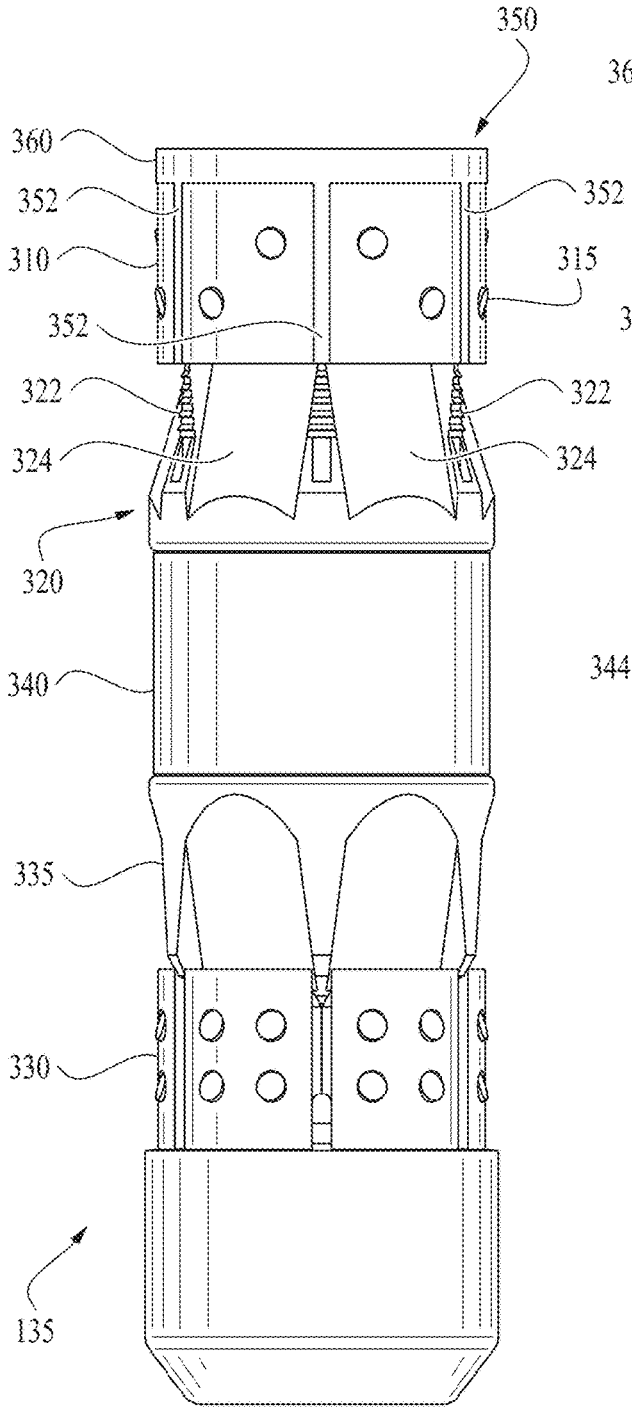
FIG. 4 provides a side elevation view of the isolation device of FIG. 3, according to embodiments of this disclosure.
Figure 5:
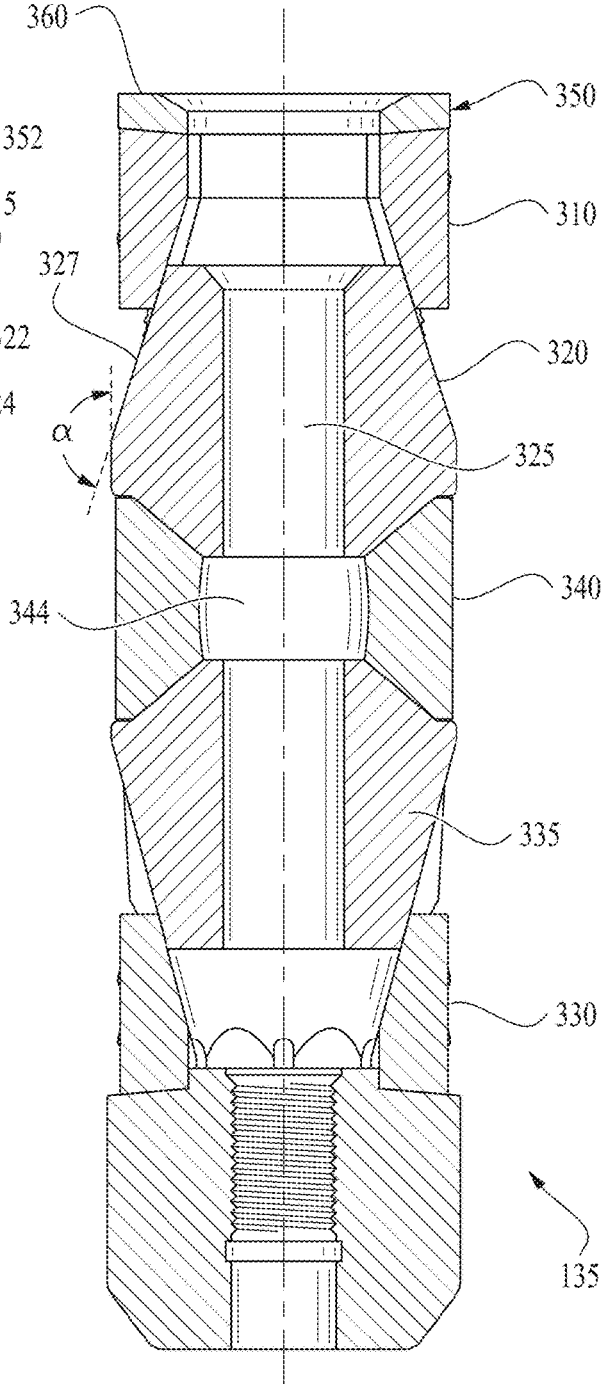
FIG. 5 provides a cross-sectional view of the isolation device of FIG. 3, according to embodiments of this disclosure.
Figure 6:
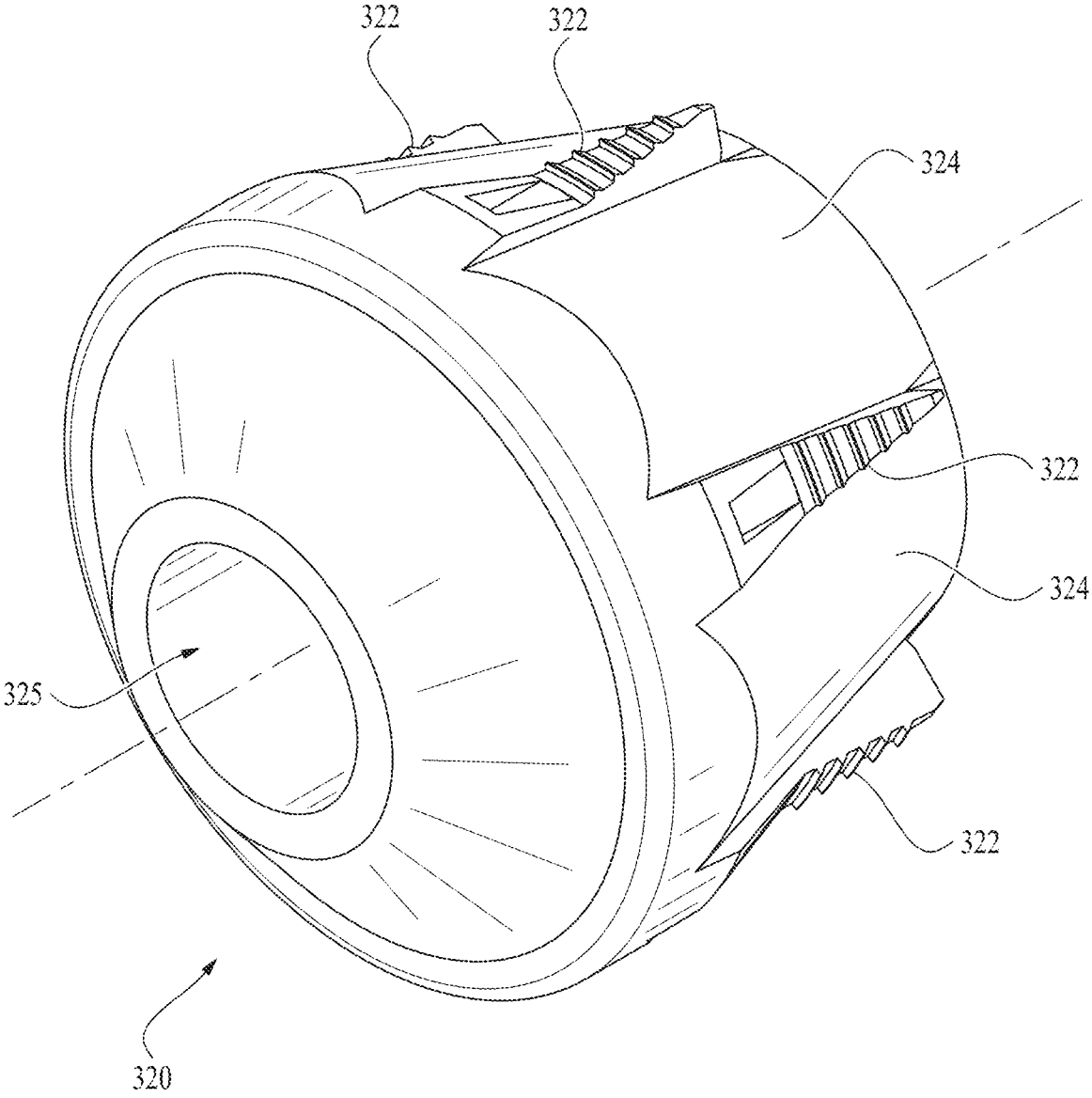
FIG. 6 provides an isometric view of the wedge portion of the isolation device of FIG. 3, according to embodiments of this disclosure.
Figure 7:
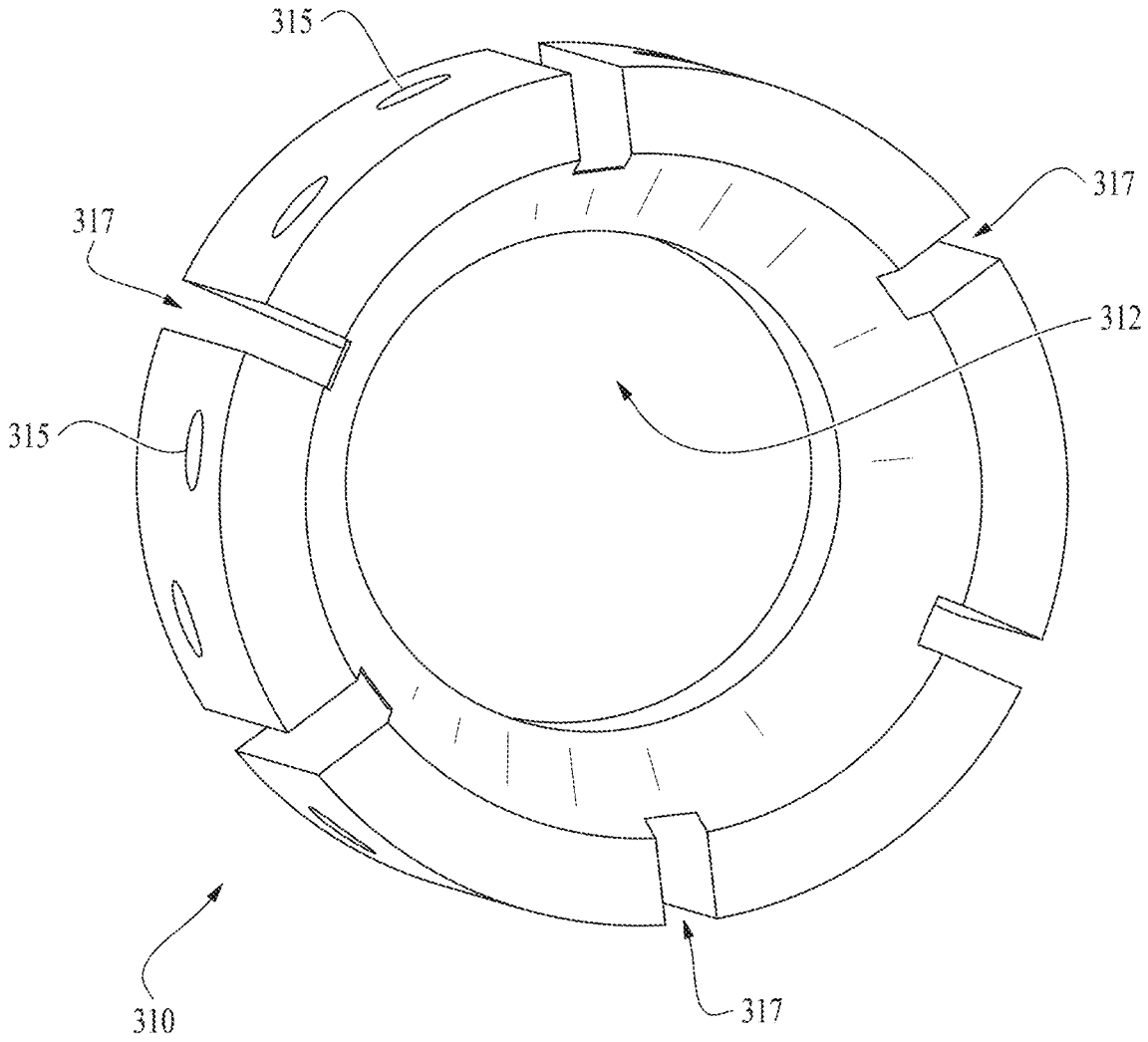
FIG. 7 provides an isometric view of the slip portion of the isolation device of FIG. 3, according to embodiments of this disclosure.
Figure 8:
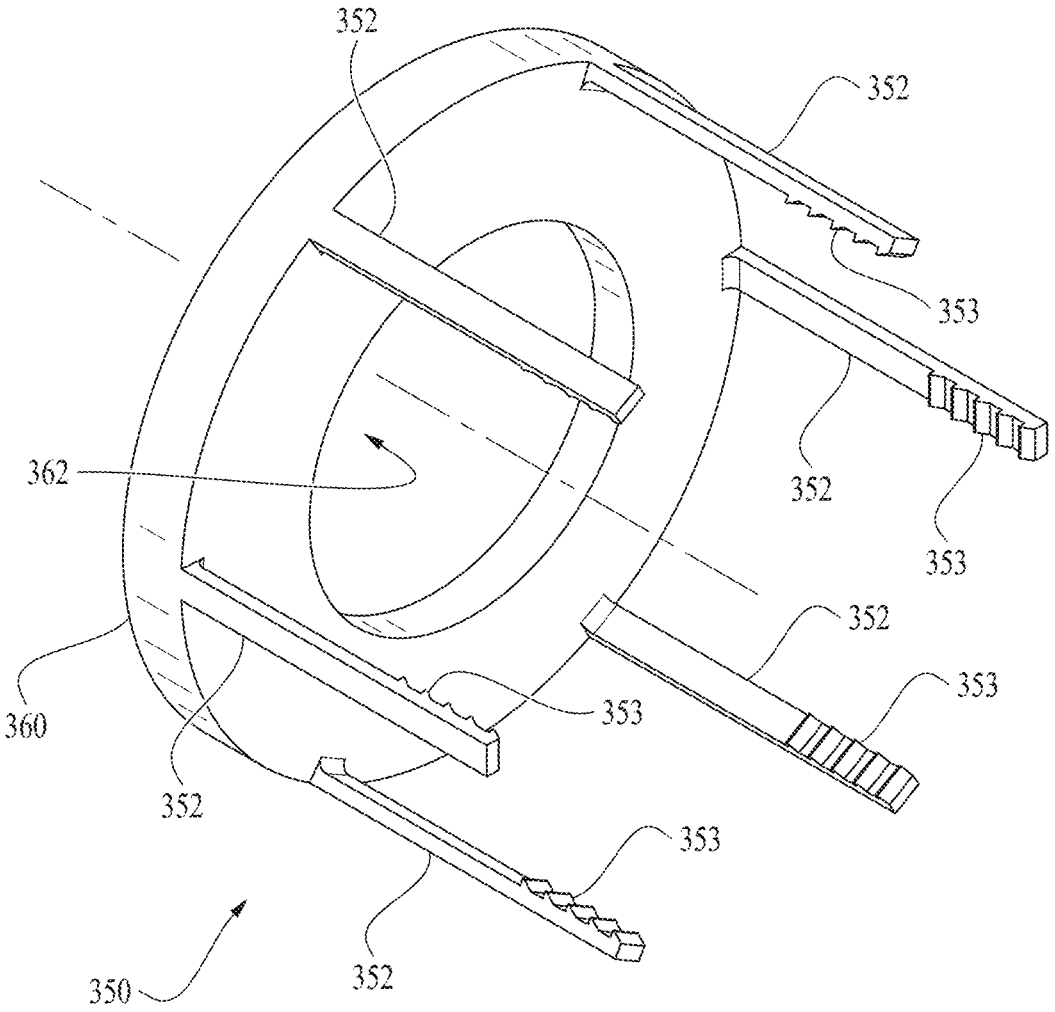
FIG. 8 provides an isometric view of the retaining mechanism of the isolation device of FIG. 3, according to embodiments of this disclosure.

FIGS. 3-5 illustrate an exemplary isolation device 135 in its first, run-in position. FIG. 6 illustrates an exemplary top wedge 320, FIG. 7 illustrates an exemplary top slip 310, and FIG. 8 illustrates an exemplary retaining mechanism 350. FIGS. 9-12 illustrate the exemplary isolation device 135 of FIG. 3 in its second, set position.

Figure 9:
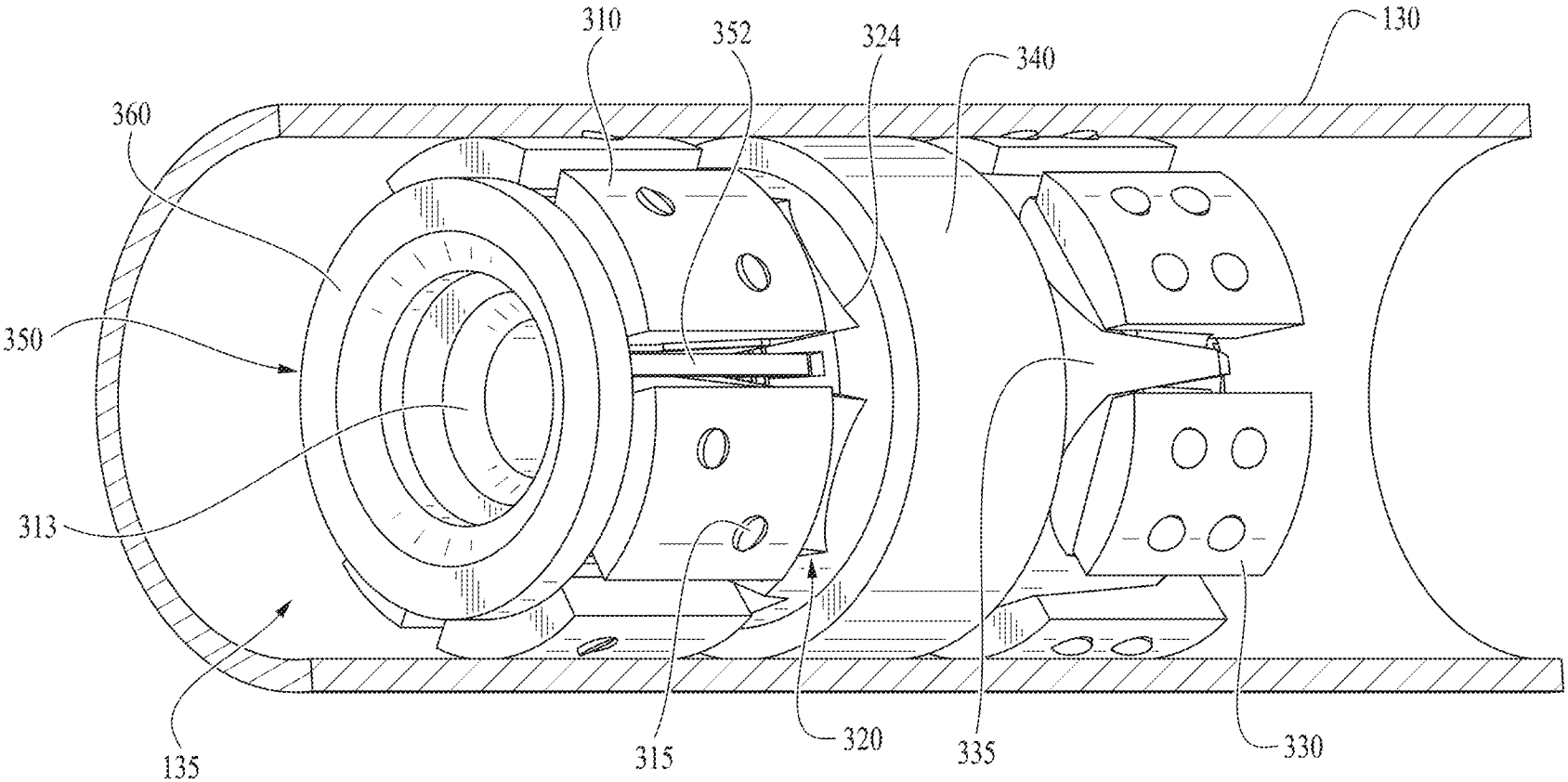
FIG. 9 provides an isometric view of the isolation device of FIG. 3 in its set state (e.g. deployed as in the exemplary wellbore of FIG. 2), according to embodiments of this disclosure.
Figure 10:
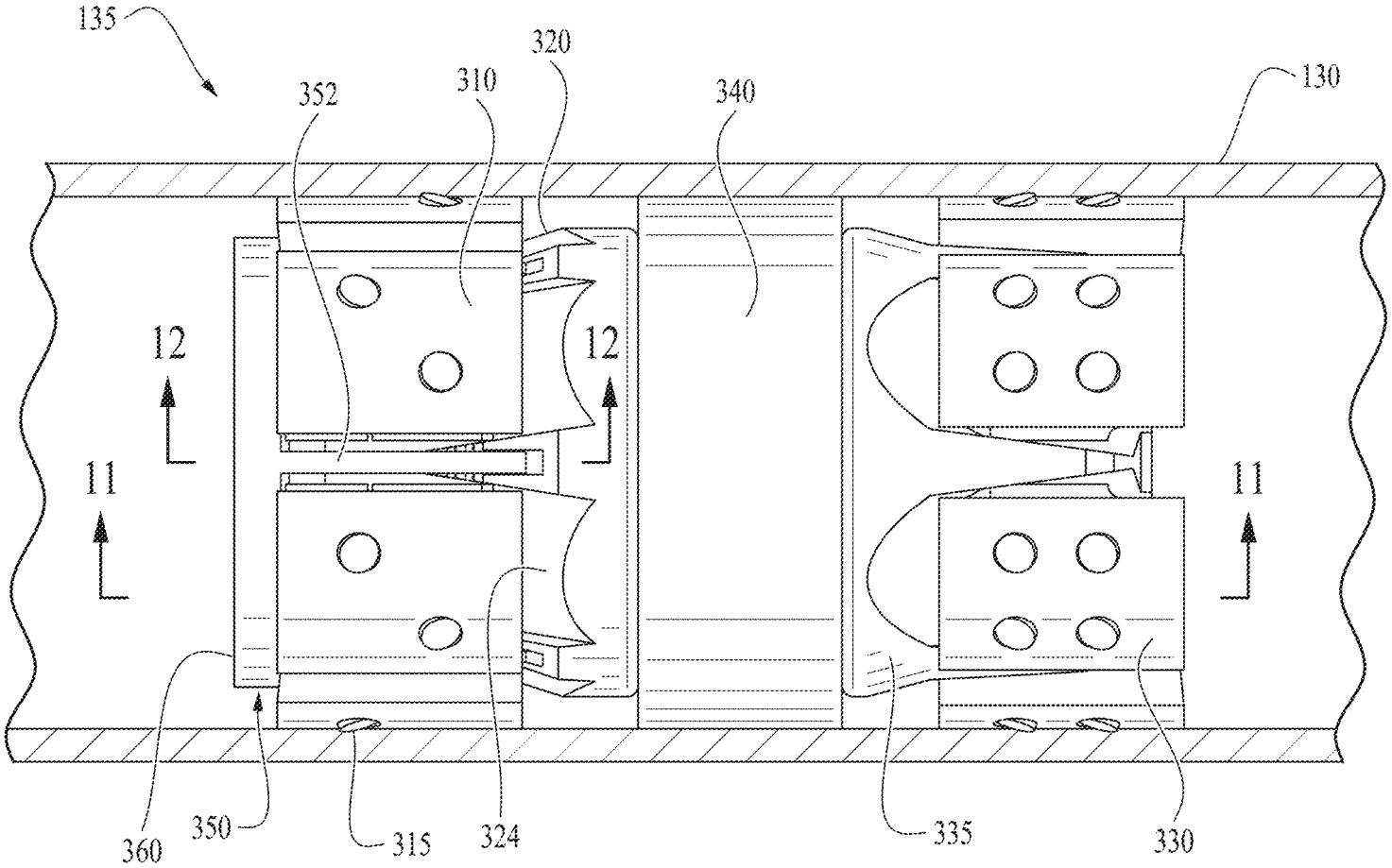
FIG. 10 provides a side elevation view of the isolation device of FIG. 9, according to embodiments of this disclosure.
Figure 11:
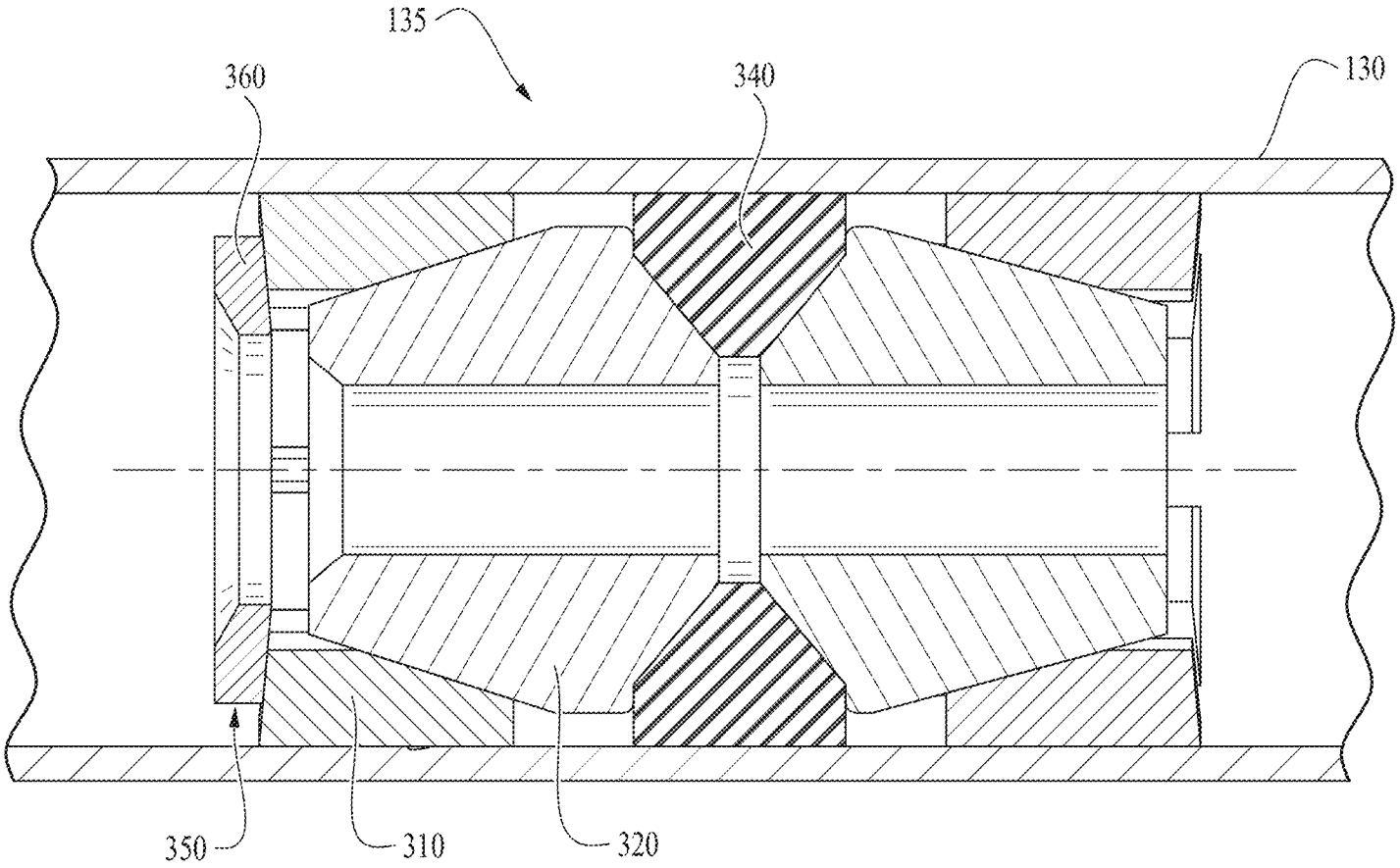
FIG. 11 provides a cross-sectional view of the isolation device of FIG. 9, according to embodiments of this disclosure.

Turning in more detail to FIGS. 3-8, an exemplary isolation device 135 is illustrated in its run-in position (with FIGS. 9-12 illustrating the exemplary isolation device 135 in its set state). As shown in FIG. 3, the zonal isolation device 135 may include a top slip 310, a top wedge 320, a bottom slip 330, a bottom wedge 335, a seal element 340, and a retaining mechanism 350. The top slip 310 can be configured in engagement with the top wedge 320 (e.g. engagement with the exterior surface/angled surface 327 of the top wedge 320), for example with the top slip 310 having a run-in position with respect to the top wedge 320 (e.g. as shown in FIG. 3) and a set position with respect to the top wedge 320 (e.g. as shown in FIG. 9). The seal element 340 can be disposed between the top wedge 320 and the bottom wedge 335, and may be configured to expand radially (e.g. into sealing contact with the wellbore/casing) as the top slip 310 transitions from the run-in position to the set position. For example, movement of the top slip 310 and the bottom slip 330 towards each other can cause (for example, due to corresponding movement of the top wedge 320 and bottom wedge 335 towards each other) the seal element 340 to expand radially outward for engagement with an inner diameter of the wellbore (e.g. due to compression of the seal element 340). The retaining mechanism 350 can be configured to allow movement of the top slip 310 from its run-in position (e.g. as shown in FIG. 3) towards its set position (e.g. as shown in FIG. 9), but to prevent movement of the top slip 310 away from the set position (e.g. uphole). For example, the retaining mechanism 350 can lock the top slip 310 in the set position and/or lock against uphole movement (e.g. preventing axial movement that would allow axial separation of the top slip 310 from the top wedge 320 and/or which could lead to dislocation of the top slip 310).

The seal element 340 can comprise an elastomeric (e.g. rubber) element configured to expand radially outward as it is compressed axially. As can be seen by comparing FIG. 5 and FIG. 11, the set position of the top slip 310 can be axially closer to the seal element 350 than the run-in position. In set position, an outer diameter of the top slip 310 (and the seal element 340) is larger than an outer diameter of the top slip 310 in the run-in position. For example, the top slip 310 can be configured to expand radially as the top slip 310 moves axially from the run-in position to the set position (e.g. towards the seal element 350 and/or up the angled surface of the top wedge 320). The top slip 310, top wedge 320, and seal element 340 can each have an axially extending bore (312, 325, and 344 respectively, and the bottom wedge 335 and bottom slip 330 may also have axially extending bores), with aligned bores providing a longitudinal bore through the entire isolation device 135. A ball seat 313, configured to receive a ball for sealing of the bore, may be formed by the top slip 310, top wedge 320, and/or the retaining mechanism 350 (e.g. at an upper end, distal to the seal element 340).

In some embodiments, the top slip 310 and/or the bottom slip 330 may have a plurality of anchoring elements (e.g. pills or teeth) 315, for example disposed on its exterior surface and/or configured to dig into the casing/wellbore in the set position. In some embodiments, the top slip 310 and/or bottom slip 330 can be configured to be frangible or dissolvable. In the embodiment of FIG. 3, the top slip 310, the bottom slip 330, the top wedge 320, the bottom wedge 335, and the seal element 340 may be configured to be disposed around a (e.g. removable) mandrel (e.g. during setting), for example as shown in in FIG. 13. In embodiments, the top wedge 320 and the bottom wedge 335 can be configured to be self-supporting after removal of the mandrel (e.g. after setting).

In embodiments, the retaining mechanism 350 can include a first retaining element (e.g. disposed on the arms, as discussed below) and a second retaining element (e.g. disposed on the top wedge 320, as discussed below), wherein the first and second retaining elements are configured to matingly engage to allow movement of the top slip 310 from the run-in position (e.g. as shown in FIG. 3) towards the set position (e.g. as shown in FIG. 9), but to prevent movement of the top slip 310 away from the set position. For example, the retaining mechanism 350 may be configured to lock the top slip 310 in the set position, for example with the top slip 310 disposed between and/or in positive contact with the retaining mechanism 350 and the top wedge, and the axial position of the retaining mechanism with respect to the top wedge being fixed. In some embodiments, the retaining mechanism 350 may include a ratchet and/or latch, for example configured to fix axial position at one or more location.

Figure 12:
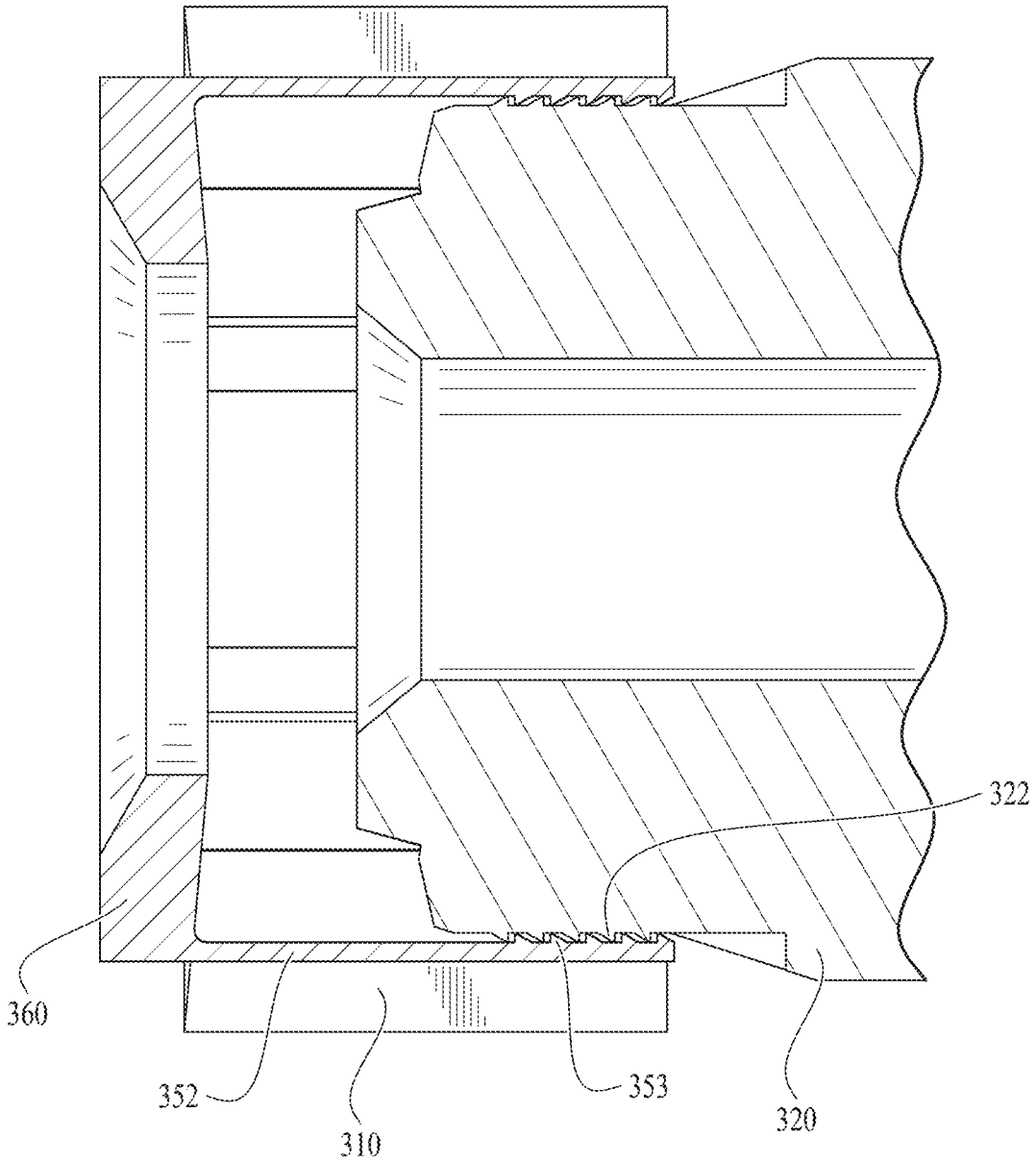
FIG. 12 provides a partial cross-sectional view of the isolation device of FIG. 9 (at a different location than FIG. 11, which allows interaction of the retaining features of the retaining mechanism and the wedge of the exemplary isolation device to be better viewed), according to embodiments of this disclosure.

In the embodiment of FIG. 3, the retaining mechanism 350 comprises a plurality of axially extending arms 352. For example, the first retaining element can include one or more retaining feature 353 on a plurality of arms 352. In some embodiments, each arm 352 may have one or more retaining feature 353 (for example one or more protrusion or indentation, such as a tooth or slot), which can be configured to matingly engage one or more retaining feature 322 of the top wedge 320 (for example, one or more protrusion or indentation, such as a tooth or slot, of the top wedge 320). The second retaining element can include the one or more retaining feature 322 (e.g. protrusion/teeth or indentations/slots) on the top wedge 320. FIG. 12 illustrates mating engagement of the retaining features 322, 352, for example shown in the set position, which may be configured to allow axial movement from the run-in to the set position, but to prevent axial movement from the set position towards the run-in position.

In some embodiments, the one or more retaining feature 322 of the top wedge 320 may include a plurality of retaining features 322 which are axially spaced and/or each arm 352 may have a plurality of retaining features 353 which are axially spaced. In some embodiments, the one or more retaining features 353 on each arm 352 are disposed in proximity to a distal end of each arm 352. In the embodiment of FIG. 6, the one or more retaining feature 322 of the top wedge 320 are disposed on an exterior surface of the top wedge 320. In the embodiment of FIG. 8, the one or more retaining feature 353 of the arms 352 are disposed on an interior surface of the arms 352 (e.g. the one or more retaining features 353 face radially inward). In embodiments, each retaining feature 322, 353 may comprise a first surface configured for sliding movement (e.g. with respect to the mating retaining feature) axially towards the set position, and a second surface configured for interference/overlap (e.g. with respect to the mating retaining feature) to resist movement away from the set position. For example, teeth on the arms 352 may be formed as wedge-shapes, with the angled wedge face directed towards the top wedge 320 (and in some embodiments, an upper interference face may project radially inward), and grooves or teeth on the top wedge 320 may be configured to matingly attach/receive the teeth of the arms 352.

As shown in FIG. 3, some embodiments of the retaining mechanism can also include a retaining ring 360, from which the arms 352 may extend axially. The retaining ring 360 may be configured to contact the upper end/face of the top slip 310 (e.g. with the top slip 310 disposed between the retaining ring 360 and the seal element 340 and/or top wedge 320). For example, the retaining ring 360 may be configured to remain in positive contact with the top slip 310 throughout movement from run-in position to set position and/or to positively contact the top slip 310 at the set position (e.g. so that the top slip 310 may be wedged securely in place in the set position, between the retaining ring 360 and the top wedge 320). The plurality of arms can extend axially from the retaining ring 360 (e.g. away from the bottom surface of the retaining ring 360) towards the seal element 340 and/or top wedge 320 (e.g. downhole). The retaining ring 360 has a bore/opening 362 therethrough, which may be configured to align with the other bores of the device 135 in the set position. In some embodiments, the retaining mechanism 350 can be configured to provide approximately equal force along a circumference of the top slip 310 (e.g. on the upper end of the top slip). In some embodiments, the retaining mechanism 360 can be configured with a locking force (e.g. resisting movement away from the set position towards the run-in position) of approximately 750 lbs (e.g. about 500-1000 lbs, about 500-800 lbs, about 700-1000 lbs, or about 700-800 lbs).

In some embodiments, the retaining ring 360 can have an inner diameter (e.g. diameter of opening 362) no smaller than the ball seat 313 of the top slip 310 or top wedge 320. In some embodiments, the ball seat 313 may be located on the retaining ring 360 (e.g. at its upper surface). In some embodiments, the retaining ring 360 can have an outer diameter less than the set outer diameter of the seal element 340 and/or an outer diameter no more than the run-in outer diameter of the seal element 340 and/or an outer diameter no greater than the run-in outer diameter of the top slip 310. In some embodiments, the outer diameter of the retaining ring 360 can be less than the set outer diameter of the top slip 310 and/or the set outer diameter of the seal element 340.

In the embodiment of FIG. 8, each arm 352 of the retaining mechanism 350 can extend approximately perpendicular to the retaining ring 360 (e.g. approximately parallel to the longitudinal center axis of the device and/or the opening 362). Embodiments of the retaining mechanism 350 may include 4-12, 4-6, 6-12, 4-8, 8-12, or 6-8 arms 352. The plurality of arms 352 may be spaced around a circumference of the retaining ring 360 (e.g. extending axially outward from the ring 360 at different locations around the circumference of the ring 360). In some embodiments, the arms 352 may be evenly spaced around the circumference. In some embodiments, an exterior surface of each arm 352 may be approximately flush with an exterior (e.g. outer diameter) of the retaining ring 360. In embodiments, the arms 352 may extend axially beyond the top slip 310 (e.g. towards the seal element 340 and/or top wedge 320 retaining features).

In the set position, the retaining mechanism 350 and the top wedge 320 can form a cage around the top slip 310. For example, the retaining mechanism 350 and top wedge 320 may provide positive contact with the top slip 310 to fix both its axial and radial position. In embodiments, in the set position the retaining ring 360 may contact the top slip 310 on its upper side/face/end, while the top wedge 320 may contact the top slip 310 in proximity to its lower side/face/end (e.g. axially fixing the top slip 310 therebetween, for example with positive contact on the top and bottom of the top slip 310 in its set position). In embodiments, the top slip 310 may be held radially in its set position by the arms 352 and/or by press-fit within the wellbore (e.g. against the casing 130) and by the top wedge 320 (e.g. radially fixing the top slip 310 therebetween, for example with positive contact on exterior and interior surfaces of the top slip 310). For example, the angled surface 327 of the top wedge 320 may lock the top slip 310 both axially from below and radially from within, the retaining ring 360 may lock the top slip 310 axially from above, and/or the arms 352 and/or wellbore (e.g. casing 310) may lock the top slip 310 radially from without. Thus, when the retaining mechanism locks the set position (e.g. with the retaining features 322 and 353 preventing the top slip 310 from moving out of the set position), the top slip 310 can be held securely in the set position, for example by positive contact on all sides. In embodiments, the retaining mechanism 350 may be configured to prevent dislocation of the set top slip 310, for example even under high pressure and/or high volume pumping.

In some embodiments, the top slip 310 can have a plurality of axially extending slots 317 on its exterior surface. The slots 317 may be configured for interaction with the arms 352 of the retaining mechanism 350, for example with the arms 352 of the retaining mechanism 360 extending axially through the slots 317. The number of slots 317 can equal the number of arms 352, for example with the circumferential spacing of the slots 317 matching the spacing of the arms 352. The width of each arm 352 can be less than the width of the corresponding slot 317, allowing axially extending passage of the arms 352 through their corresponding slots 317. In embodiments, the depth of slots 317 can be configured to allow for radial expansion of the top slip 310 when moving from run-in to set position, for example with the slot 317 depth being sufficient so that, at set position, the top slip 310 does not bow out the arms 352 radially (e.g. the arms 352 may not experience force pressing radially outward from the top slip 310). In some embodiments, all of the arms 352 can be identical (e.g. in shape, size, configuration, etc.), and all of the slots 317 can be identical as well. In some embodiments, the retaining ring 360 can be configured to block/restrict fluid flow axially through/across the slots 317.

As shown in FIGS. 3 and 6, the top wedge 320 can comprise a plurality of wedge elements 324. The wedge elements 324 may be configured so that axial movement of the top slip 310 with respect to the top wedge 320 (e.g. moving from run-in position to set position) induces radial movement/expansion of the top slip 310, for example so that when the top slip 310 is at set position, it contacts the wellbore (e.g. casing 130). Each top wedge element 324 can include an angled surface 327, which may be configured to transition the top slip 310 radially (e.g. outward) from the run-in position to the set position (e.g. when compression force is applied axially to the device to induce axial movement of the top slip 310 with respect to the top wedge 320). For example, the angled surface 327 of each wedge element 324 may be oriented at a wedge angle $\alpha$ from the longitudinal axis (see for example, FIG. 5). In embodiments, the wedge angle $\alpha$ may be less than 180 degrees, such as approximately 100 to 170 degrees. In some embodiments, the wedge angle $\alpha$ may be set to allow the top wedge 320 to be self-supporting (e.g. in conjunction with the bottom wedge 335), so that an inner mandrel can be used during run-in and setting, but may be removed once the device 135 is set. In some embodiments, the plurality of wedge elements 324 may be spaced evenly around the circumference of the top wedge 320.

As shown in the embodiment of FIG. 6, the one or more retaining feature 322 of the top wedge 320 can be disposed between the wedge elements 324. For example, the retaining features 320 can be aligned with the slots 317 of the top slip 310 and the arms 352 extending therethrough (e.g. with the slots 317 offset from the wedge elements 324). The retaining features 322 of the top wedge 320 can be disposed on the exterior surface of the top wedge 320 (e.g. facing radially outward, and configured for mating engagement with the retaining features 353 of the arms 352). The one or more retaining feature 322 between adjacent wedge elements 324 can comprise a plurality of retaining features 322 axially spaced between adjacent wedge elements 324. By having a plurality of axially spaced retaining features 322 and/or 353, the isolate device 135 may have a plurality of possible set positions, which may allow the same isolation device 135 to be operable and/or effective within wellbores (e.g. casing 130) of varying diameters. For example, the retaining mechanism 350 can be configured for effective setting of the corresponding top slip 310 within a wellbore having an inner diameter of approximately 4.670-4.892 inches.

In some embodiments, the axially spaced wedge retaining features 322 can have 3-10, 3-7, 3-5, 5-7, 5-10, or approximately 5 axially spaced retaining features 322 (e.g. spaced between each pair of adjacent wedge elements 324). In some embodiments, the axially spaced arm retaining features 353 can have 3-10, 3-7, 3-5, 5-7, 5-10, or approximately 5 axially spaced retaining features 353 (e.g. disposed in proximity to the distal end of each arm 352). In some embodiments, the retaining mechanism 350 can be configured with 5-20, 5-15, 5-10, 10-15, 10-20, or approximately 10 axial locations (e.g. possible set positions, for example as defined by the interaction of the retaining features 322 and 353). In some embodiments, the retaining mechanism 350 may not be engaged in the run-in position, while in other embodiments, it may be engaged at the most axially uphole position in the run-in position. While the embodiment shown in FIG. 3 illustrates a retaining mechanism 350 with a plurality of axially spaced retaining features, in other embodiments, the retaining mechanism 350 may be configured for use with only a single wellbore size (e.g. with the arms 352 and the top wedge 320 each having only a single mating retaining element).

The components of the isolation device 135 can be made from or include a variety of materials including, but not limited to, metals, metal alloys, dissolvable materials, molded hardened polymers, resins, or resin/glass composites. Examples of metals or metal alloys that can be used include, but are not limited to, cast iron and aluminum. The seal element 340 can be made from elastomeric materials including, but not limited to, natural rubbers, styrene-butadiene block copolymers, polyisoprene, polybutadiene, ethylene propylene rubber, ethylene propylene diene rubber, silicone elastomers, fluoroelastomers, polyurethane elastomers, nitrile rubbers, and dissolvable, elastomeric materials. The components of the isolation device 135 can have a variety of dimensions that are selected for the particular wellbore operation in which the isolation device 135 is used.

Figure 13:
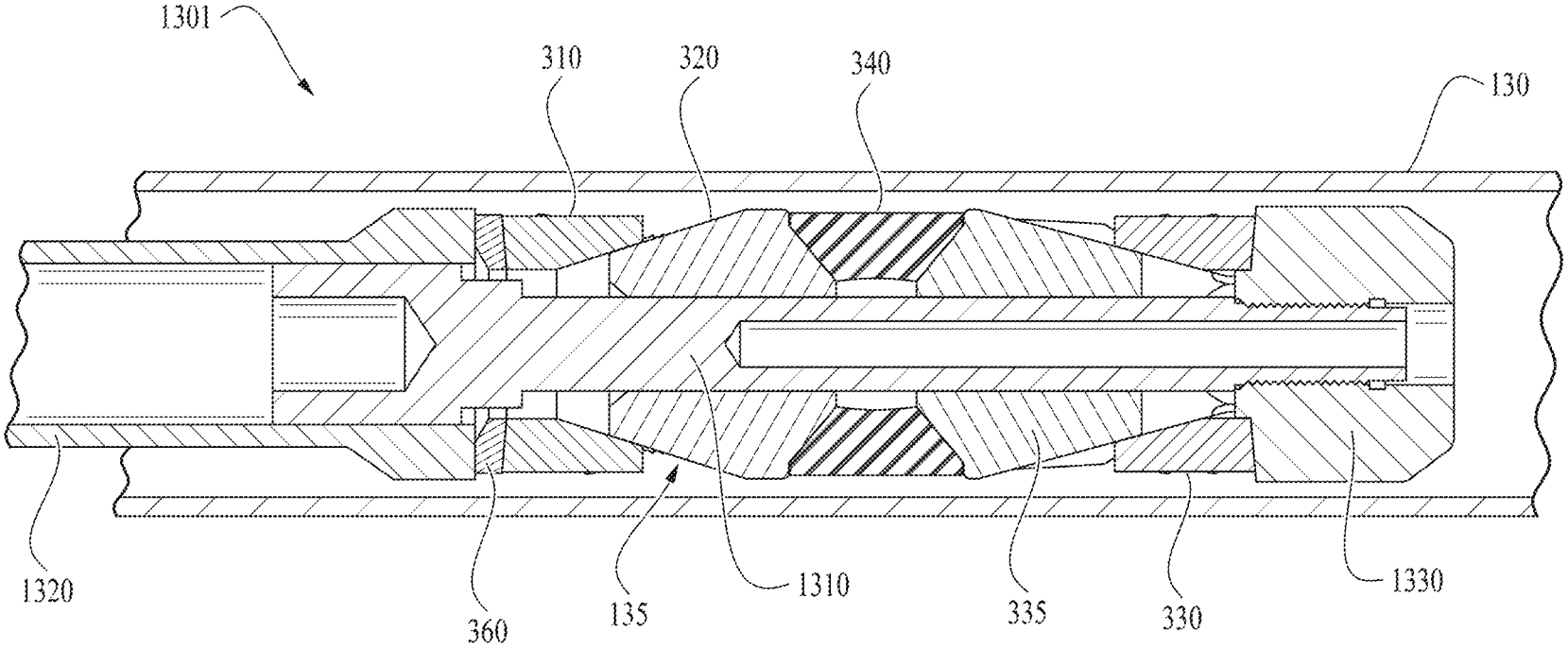
FIG. 13 illustrates via schematic cross-section an exemplary system for deploying an exemplary isolation device (e.g. in its run-in state) downhole in a well, according to embodiments of this disclosure.

A comparison of FIGS. 3-5 (showing the run-in position of the device 135) to FIGS. 9-12 (showing the set position of the device 135) may demonstrate how the isolation device 135 can operate across the range of its movement, along with the interactions of the various components. FIG. 13 illustrates an exemplary system 1301, which can be used to isolate a zone of a well. The system 1301 can include an isolation device 135, for example similar to embodiments described with respect to FIGS. 3-12, a mandrel 1310, and a mule shoe 1330. The mandrel 1310 may be configured to support the isolation device 135 during run-in and/or setting in the wellbore. In some embodiments, the mandrel 1310 may be configured to be removable from the isolation device 135 after setting (e.g. with the interaction between the mandrel 1310 and the isolation device 135 allowing the isolation device 135 to be self-supporting after removal of the mandrel 1310). For example, the mandrel 1310 can be removable from the isolation device 135 after engagement of the seal element 340 with an inner diameter of the wellbore (e.g. casing 130), for example opening the longitudinal bore through the isolation device 135. The mandrel 1310 may be configured for connection to a setting tool 1320 (e.g. during run-in and/or setting).

In embodiments, the mandrel 1310 may be configured for attachment to a setting tool 1320, for example with the mandrel 1310 disposed at the downhole end of the setting tool 1320. The mule shoe 1330 can be configured for removable connection to the mandrel 1310, for example in proximity to the bottom (e.g. downhole end) of the mandrel 1310. For example, the connection of the mule shoe to the mandrel can be shearable, which may allow separation from the mandrel 1310 after setting is complete (e.g. by continued application of compression (e.g. using the setting tool) after setting of the isolation device 135). For example, the mule shoe 1330 can have threads (which may be shearable) for connecting the mule shoe 1330 to the bottom end of the inner mandrel 1310 (e.g. via threads on the inner mandrel 1310). Some embodiments may further comprise a setting sleeve, for example with the setting sleeve and/or the inner mandrel 1310 configured for connection to a setting/running tool 1320.

Figure 14:
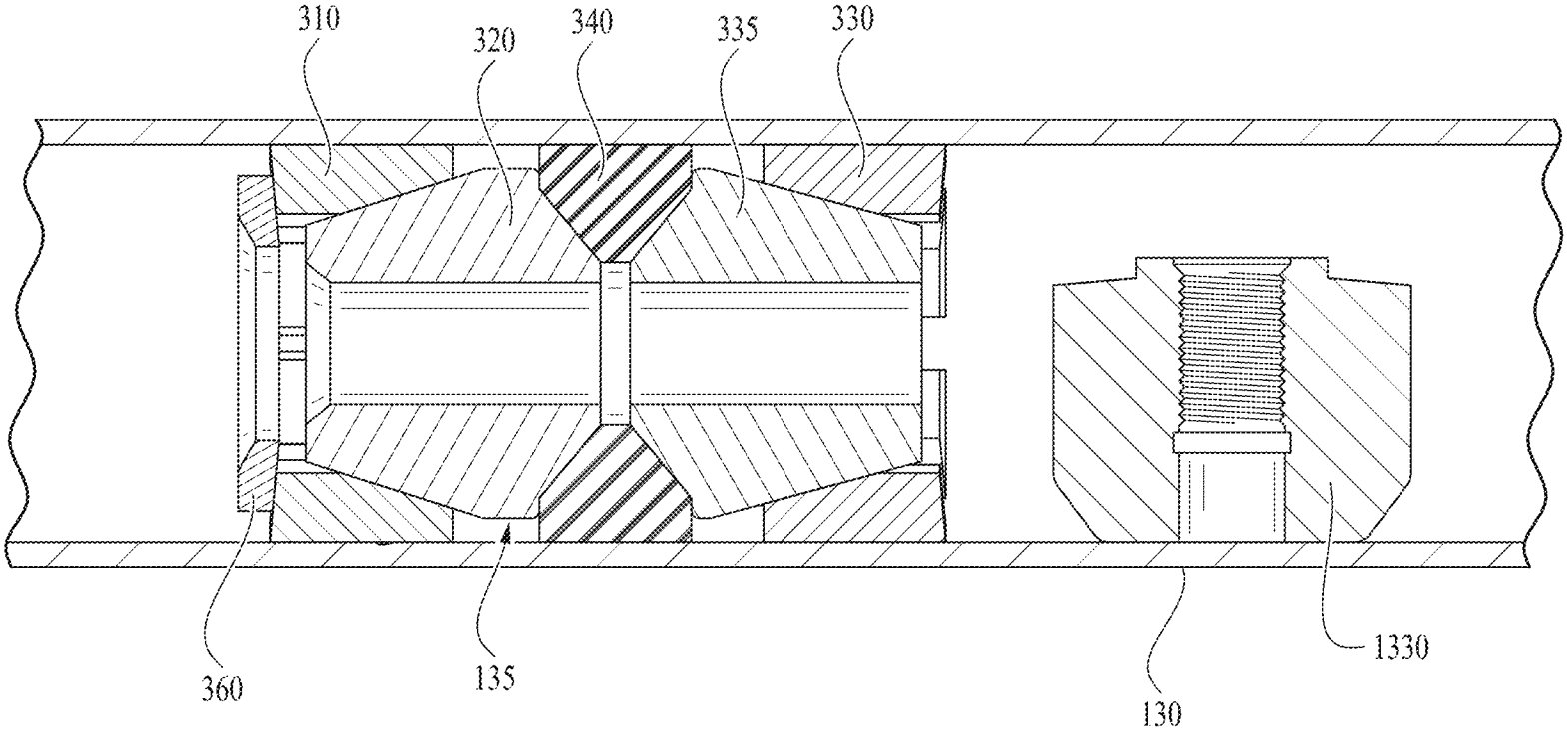
FIG. 14 illustrates via schematic cross-section the exemplary system of FIG. 13 after setting of the isolation device, according to embodiments of this disclosure.
Figure 15:
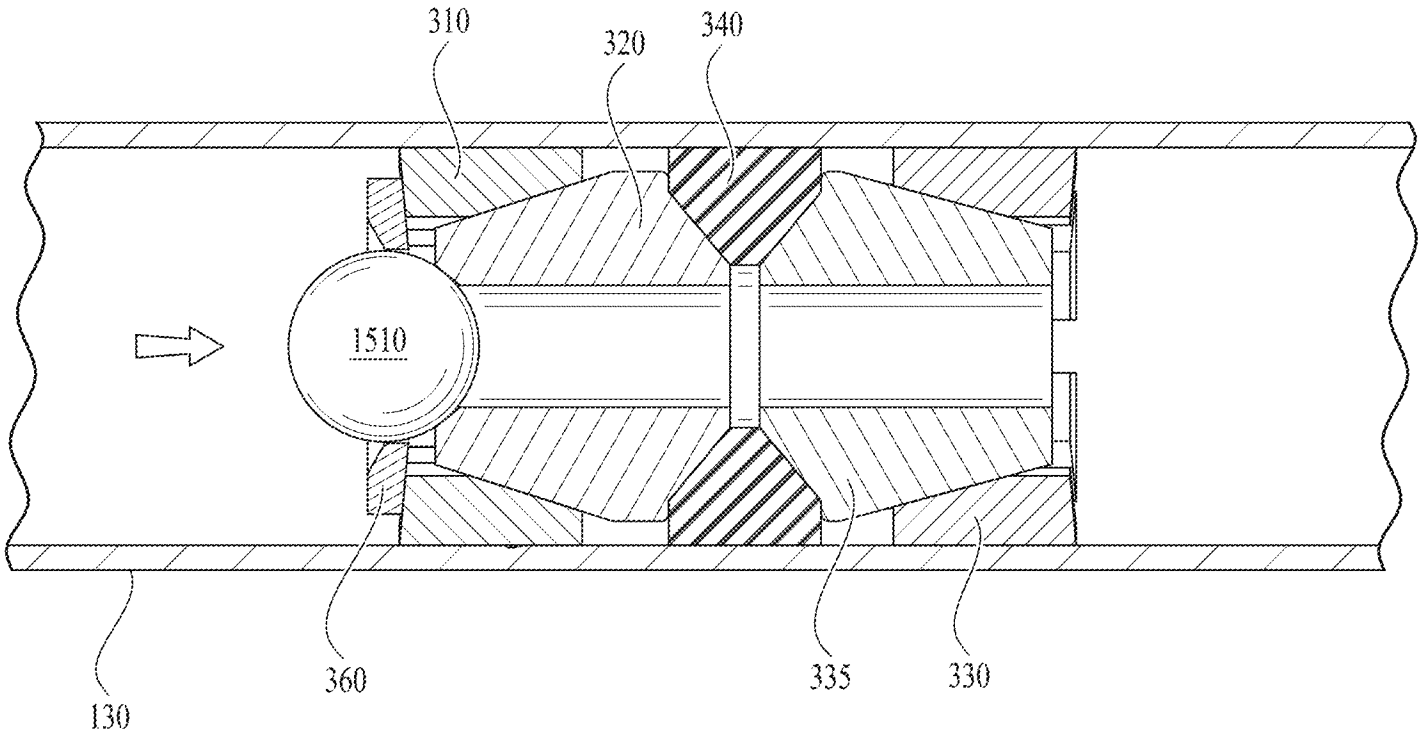
FIG. 15 illustrates via schematic cross-section the exemplary system of FIG. 14 in its full isolation state (e.g. after a ball has been dropped and seated on the set isolation device), according to embodiments of this disclosure.

As shown in the Figures, the inner mandrel 1310 can extend from an area below the mule shoe 1330, through the inner diameter/bore of the isolation device 135, and to an area above the top slip 310. In embodiments, the mandrel 1310 can be coupled to the downhole end of the setting tool 1320, and the setting tool 1320 can be coupled to the downhole end of a conveyance mechanism. The system 1310 may further comprise a ball 1510 (see for example, FIG. 15) configured to seat (e.g. sealingly) on the ball seat 313 of the isolation device 135 to prevent or restrict fluid flow (e.g. downhole) therethrough (e.g. to plug the ball seat in one direction). As shown in FIGS. 13-15, the system 1301 may be disposed downhole in a wellbore, for example to provide zonal isolation for a well. During run-in, the isolation device 135 can be disposed on the mandrel 1310, and the OD of the seal element 340 can be less than the ID of the wellbore (e.g. casing 130) (see for example, FIG. 13), but upon setting the device 135 can have an OD matching the ID of the wellbore (e.g. providing sealing contact therebetween—see for example, FIG. 14).

After the isolation device 135 is run in the wellbore to a desired location, it can be set. FIG. 15 shows the isolation device 135 after setting. In embodiments, the isolation device 135 can be mechanically set using wireline or hydraulic setting tools, for example. Unlike conventional isolation device plugs that are set using a spacer ring, the isolation device 135 of FIG. 13 may not have a spacer ring and/or can also include a setting sleeve in some embodiments. For example, the setting sleeve can be attached to the setting tool 1320. The inner mandrel 1310 can also be attached to the setting tool 1320 (e.g. directly or indirectly), such that after setting, the inner mandrel 1310 and the setting sleeve can be removed from the wellbore, for example leaving only the slip system (e.g. top and bottom slips 310, 330, top and bottom wedges 320, 335, and the seal element 340) within the wellbore.

Setting the isolation device 135 can involve applying compression to the slip system to move the slips 310, 330 axially towards and along the face of the wedges (e.g. slip props) 320, 335 and radially away from the inner mandrel 1310 and into engagement with the I.D. of the wellbore (e.g. tubing string or casing 130) and to allow the top slip 310 to maintain engagement with the wellbore (e.g. tubing string or casing 130). In some embodiments, the setting sleeve/device can be mechanically actuated. The force applied to the device can increase the load on the slips 310, 330, which may cause them to break via the slots or grooves 317 and ramp up the angled surfaces (e.g. 324) of the wedges (e.g. 320) towards each other. Compression that is applied to the slip system can cause the top slip 310 to move along the top wedge 320, which in turn can cause a lower end of the mule shoe 1330 to move towards the top slip 310. Movement of the mule shoe 1330 can cause the bottom slip 330 to move along the bottom wedge 335. The wedges 320, 335 can support the slips 310, 330 in an expanded position outward from the inner mandrel 1310 such that the slips 310, 330 engage the I.D. of the wellbore (e.g. tubing string or casing 130) when the isolation device 135 is set. The wedges 320, 335 can prevent the slips 310, 330 from retracting and releasing from the I.D. of the wellbore (e.g. tubing string or casing 130) once the isolation device 135 is set. When the slips 310, 330 are engaged with the wellbore (e.g. tubing string or casing 130), the isolation device 135 has substantially limited or no vertical movement within the wellbore.

Setting the isolation device 135 can further involve causing the seal element 340 to expand radially away from the inner mandrel 1310 to form a pressure tight annular seal. The seal element 340 can radially expand outwardly away from the inner mandrel 1310 to engage with an inner diameter of the wellbore (e.g. tubing string or casing 130) when the isolation device 135 is set. In embodiments, downward movement of the setting sleeve/device and upward movement of the mule shoe 1330 can cause the wedges 320, 335 to move towards each other and can axially compresse the seal element 340 to cause it to expand radially into engagement with the I.D. of the wellbore (e.g. tubing string or casing 130). Engagement of the seal element 340 with the inside of the wellbore (e.g. tubing string or casing 130) can preferably restrict fluid flow past the seal element 340 (e.g. restricting or substantially preventing fluid flow past the exterior of the isolation device 135 (e.g. between the exterior of the isolation device and the inner diameter of the wellbore) when set).

In some embodiments, the seal element 340 does not engage the inner mandrel 1310 after the isolation device 135 is set. As shown in FIG. 5, the top wedge 320 can include an angled surface 327 (e.g. and the bottom wedge 335 can include a second angled surface, which in some embodiments may be similar to the other angled surface). The angle of the angled surfaces can be selected such that after setting, the seal element 340 is inhibited or prevented from engaging with the inner mandrel 1310. By way of example, the angle $\alpha$ can be in the range of approximately 100° to 170°. In this manner, expansion of the seal element 340 can be in a direction away from the inner mandrel 1310, and the seal element 340 can be substantially prevented from being in direct engagement with the inner mandrel 1310 after setting.

As shown in FIG. 13 the mule shoe 1330 can include threads for connecting the mule shoe 1330 to the inner mandrel 1310 via threads on the inner mandrel 1310. In some embodiments, the wedges 320, 335 can include threads to connect to the inner mandrel 1310 during the run-in position. In alternate embodiments, the wedges 320, 335 may not include threads for connecting to the inner mandrel 1310. Continued force applied to the slip system can cause the wedges 320, 335 to shear from the inner mandrel 1310 when threads are included. The shear force required to shear the wedges 320, 335 from the inner mandrel 1310 can be less than the force required to shear the mule shoe 1330 from the inner mandrel 1310. Continued force applied to the slip system can also cause movement (e.g. axial movement) of the slips 310, 330, the wedges 320, 335, and the seal element 340. When the slips 310, 330, the wedges 320, 335, and the seal element 340 have moved into the fully set position, the force being applied no longer causes movement of the components. The system 1310 can then reach a predetermined force that shears the mule shoe 1330 from engagement with the inner mandrel 1310, for example as shown in FIG. 14. After the isolation device 135 has been set and the mule shoe 1330 has been sheared, the setting sleeve, the setting tool 1320, and/or the inner mandrel 1310 can be removed from the wellbore. The step of removing can include removing the setting tool (not shown) that is connected to the setting sleeve and inner mandrel.

The isolation device 135 can include a fluid flow path defined by an inner diameter/bore of the isolation device 135. The flow path through the inner diameter of the isolation device 135 can allow fluids to flow from or into the subterranean formation via a conduit defined by the tubing string or casing 130.

The wedges 320, 335 can be configured to be self-supporting after removal of the inner mandrel 1310. As used herein, the term "self-supporting" means the wedges do not require a reinforcing element, such as a mandrel, in order to maintain structural integrity and a fixed position. Thus, the wedges are able to maintain the slips in engagement with the I.D. of the wellbore without the need for a mandrel or other component to support the wedges from the inside of the device 135.

The fluid flow path through the device 135 can be closed, for example by dropping a ball downhole. As seen in FIG. 15, a ball 1510 can become seated on a ball seat (for example onto the top wedge 320) when fluid flow is in the direction downhole. According to these embodiments, the ball 1510 can have an outer diameter that is greater than the inner diameter of the ball seat 313. It is to be understood that the relative terms "top" and "bottom" are used for convenience purposes and are not meant to indicate a specific orientation.

When desired, fluid flow can be restored through the inner diameter of the isolation device 135. By way of example, if the ball 1510 is seated by flowing the ball in the direction downhole, then fluid flow can be restored by flowing a fluid in the opposite direction (e.g. uphole), which will unseat the ball 1510.

In embodiments, all or a portion of the isolation device 135 can be removed from the wellbore when desirable. Removal can be accomplished by drilling, milling, or dissolving the components of isolation device 105, for example.

Methods of providing zonal isolation can include some or all of the following: introducing the isolation device 135 into a wellbore (e.g. tubing string or casing 130); setting the isolation device 135 at a desired location within the wellbore (e.g. tubing string or casing 130); shearing the mule shoe 1330; removing the setting sleeve and/or setting tool 1320 and the inner mandrel 1310 (e.g. via the conveyance mechanism); seating a ball 1510 against the isolation device 135 (e.g. to isolate a portion/zone of the well); performing a treatment operation (such as fracing) within the isolated zone; unseating the ball 1510; and removing all or a portion of the isolation device 135. In some embodiments, the mandrel 1310 may be reused in another well and/or with another isolation device after its removal form the wellbore. The methods can further include fracturing a portion of a subterranean formation that is penetrated by the wellbore. The step of fracturing can include introducing a fracturing fluid into a zone of the formation, wherein the fracturing fluid creates or enhances a fracture in the formation.

For example, a method of isolating a zone of (a subterranean formation of) a well, can comprise one or more of the following: setting an isolation device at a desired location within a wellbore/tubing string; removing an inner mandrel of the isolation device after setting; and seating a ball onto a ball seat of the isolation device. In embodiments, setting an isolation device can comprise mechanically actuating a top slip and a bottom slip into engagement with an inner diameter of the wellbore; causing axial movement of the top and bottom wedges (e.g. towards each other), wherein the movement causes a seal element disposed between the top and bottom wedges to become engaged with the wellbore (e.g. to expand radially outward and into sealing contact with the wellbore); and fixing/locking/retaining the top slip in a set position (e.g. using a retaining mechanism, which may be similar to embodiments described herein) and/or preventing dislocation of the set top slip (e.g. using the retaining mechanism). The isolation device can be similar to embodiments described herein (e.g. similar to FIGS. 3-12). FIG. 13 illustrates an exemplary system for setting an isolation device in a wellbore, for example showing the isolation device in run-in position at the downhole end of a setting tool. FIG. 14 illustrates the system of FIG. 13 after setting and removal of the mandrel. FIG. 15 illustrates the system once the ball has been seated on the set isolation device. FIG. 1 illustrates running-in the isolation tool (e.g. at the downhole end of a tool string, which may include a setting tool), and FIG. 2 illustrates the isolation device in place in the wellbore after setting and removal of the mandrel.

In some embodiments, fixing/locking/retaining the top slip may comprise forming a cage around the top slip, wherein the top slip is secured between a retaining mechanism and the top wedge (e.g. and the casing/wellbore). In some embodiments, fixing/locking/retaining the top slip may comprise maintaining positive contact between a retention ring of the retaining mechanism and the top slip during movement and/or locking (e.g. preventing axial movement away from the seal element or set position) the axial position of the retaining mechanism with respect to the top wedge. In some embodiments, mechanically actuating a top slip may comprise moving the top slip from a run-in position to a set position (e.g. wherein the set position is axially closer to the seal element of the isolation device than the run-in position, and wherein the run-in position has a smaller OD than the set position). In some embodiments, mechanically actuating the top and bottom slip may comprise applying axial compressive force to the top and/or bottom slip and/or moving the top slip and the bottom slip closer together (e.g. towards each other and/or the seal element). In the set position, the top slip may be retained both axially and radially (e.g. the axial and radial location of the top slip with respect to the top wedge and/or seal element can be fixed/locked). In some embodiments, the retaining element and top wedge can form a pocket or retaining cage (e.g. around the top slip). In some embodiments, fixing/locking/retaining the top slip may comprise fixing the top slip at one of a plurality of axial locations (e.g. based on the size of the wellbore/casing/tubular). In some embodiments, fixing/locking/retaining the top slip may comprise ratcheting or latching the retaining mechanism to the top wedge at the set position, locking the axial position of the top slip between the top wedge and the retaining mechanism. In some embodiments, fixing/locking/retaining the top slip may comprise coupling the retaining mechanism to the top wedge at a plurality of (e.g. evenly spaced) circumferential locations (e.g. using the arms of the retaining mechanism).

In some embodiments, fixing/locking/retaining the top slip may comprise holding, with positive contact on its upper end/face/surface, the top slip in the set position (e.g. with the retaining mechanism securely contacting the upper end/face/surface of the top slip). In some embodiments, fixing/locking/retaining the top slip may comprise locking or latching the retaining mechanism to the top wedge, for example to prevent axial movement of the retaining mechanism away from the set position (e.g. uphole or away from the seal element), wherein the top slip can be disposed between the retaining mechanism and the top wedge (e.g. with positive contact of the retaining mechanism with the top slip (and therethrough the wedge) preventing axial movement downhole and/or towards the seal element). In some embodiments, the set top slip can be wedged in place between/contacting the retaining mechanism, the top wedge, the arms, and/or the wellbore. In some embodiments, the set top slip may be held securely in all directions (e.g. in the x, y, and z axis and/or radially between the top wedge and the wellbore and/or arms of the retaining mechanism, and axially between the retaining mechanism (e.g. the retaining ring) and the top wedge). In some embodiments, after setting, the retaining mechanism may hold the top slip in the set position to prevent dislocation (e.g. even under high volume pumping, for example during fracing).

Some method embodiments may further comprise maintaining a secure hold and/or positive contact on the top slip in the set position throughout downhole operations/treatment (e.g. fracing). Some embodiments may further comprise maintaining the set position of the top slip throughout downhole operations/treatment (e.g. fracing). Some method embodiments may further comprise preventing dislocation of the top slip (e.g. from the set position and/or restricting the bore of the device) throughout downhole operations/treatment (e.g. fracing), for example using the retaining mechanism (e.g. even under high volume pumping of fluid, for example during fracing). Some embodiments further comprise maintaining a fully open bore of the set isolation device throughout downhole operations/treatment (e.g. fracing), for example using the retaining mechanism (e.g. even under high volume pumping of fluid, for example during fracing).

Some method embodiments may further comprise making up the isolation tool for run-in (e.g. disposing the seal element, top wedge, bottom wedge, top slip, and bottom slip on the mandrel; disposing the retaining mechanism on the mandrel and/or in contact with the top slip (e.g. inserting the arms of the retaining mechanism through the slots on the top slip and/or to engage the top wedge—for example, engaging the bottommost retaining feature of the arms with the uppermost retaining feature of the top wedge), attaching the mandrel to the downhole end of the setting tool, and/or attaching the mule shoe to the downhole end of the mandrel). Method embodiments may further comprise disposing the isolation device on the mandrel, and attaching the mandrel to the setting/run-in tool.

Embodiments may further comprise running the isolation device (e.g. in run-in position) downhole in a wellbore (e.g. prior to setting). In some embodiments, removing the mandrel may comprise shearing the mule shoe to disconnect it from the mandrel, and removing the mandrel (e.g. from the wellbore) using the setting tool (e.g. by retracting the setting tool, for example using a conveyance mechanism). In some embodiments, seating the ball may comprise pumping the ball downhole (e.g. using fluid in the wellbore). In some embodiments, pumping the ball downhole may comprise pumping the ball (e.g. using fluid pressure) initially at a high rate, such as approximately 30-45 or 30-40 barrels per minute, and slowing the pumping when the ball is in proximity to the isolation device (e.g. slowing to approximately 10-12 barrels per minute). Method embodiments may further comprise pumping fluid (e.g. fluid for setting, formation fluid, and/or fracturing fluid) at a high rate. Embodiments may further comprise performing a treatment operation (such as fracing) within the isolated zone.

Embodiments may further comprise producing (e.g. formation fluid) from the isolated zone of the well (e.g. after fracing).

ADDITIONAL DISCLOSURE

The following are non-limiting, specific embodiments in accordance with the present disclosure:

In a first embodiment, an isolation device for use downhole in a wellbore, comprises: a slip; a wedge (e.g. slip prop), wherein the slip is in engagement with the wedge and the slip has a run-in position with respect to the wedge and a set position with respect to the wedge; a seal element configured to expand radially (e.g. into sealing contact with the wellbore/casing) as the slip transitions from the run-in position to the set position (e.g. movement of the slip along the wedge causes the seal element to expand radially outward for engagement with an inner diameter of a tubing string/casing/wellbore); and a retaining mechanism configured to allow movement of the slip from the run-in position towards the set position (e.g. downhole movement), but to prevent movement of the slip away from the set position (e.g. to lock the slip in the set position and/or against uphole movement and/or to prevent axial movement that would allow axial separation of the slip from the wedge).

A second embodiment can include the device of the first embodiment, wherein the set position is axially closer to the seal element than is the run-in position.

A third embodiment can include the device of the first or second embodiment, wherein in the set position, an outer diameter of the slip is larger than an outer diameter of the slip in the run-in position (e.g. the slip is configured to expand radially as the slip moves axially from the run-in position to the set position).

A fourth embodiment can include the device of any one of the first to third embodiments, wherein the seal element comprises an elastomeric (e.g. rubber) element configured to expand radially outward as it is compressed axially.

A fifth embodiment can include the device of any one of the first to fourth embodiments, wherein the retaining mechanism comprises a first retaining element and a second retaining element, wherein the first and second retaining elements are configured to matingly engage to allow movement of the slip from the run-in position towards the set position, but to prevent movement of the slip away from the set position (e.g. to lock the slip in the set position).

A sixth embodiment can include the device of any one of the first to fifth embodiments, wherein the retaining mechanism comprises a ratchet and/or latch.

A seventh embodiment can include the device of any one of the first to sixth embodiments, wherein the retaining mechanism comprises a plurality of axially extending arms.

An eighth embodiment can include the device of the seventh embodiment, wherein the first retaining element comprises one or more retaining feature on a plurality of the arms (e.g. on each arm) (for example, each arm comprises one or more protrusion or indentation (e.g. tooth or slot) configured to matingly engage one or more protrusion or indentation (e.g. tooth or slot) of the wedge).

A ninth embodiment can include the device of any one of the fifth to eighth embodiments, wherein the second retaining element comprises one or more retaining feature (e.g. protrusion/teeth or indentations/slots) on the wedge.

A tenth embodiment can include the device of the ninth embodiment, wherein the one or more retaining feature of the wedge comprises a plurality of retaining features which are axially spaced.

An eleventh embodiment can include the device of any one of the eighth to tenth embodiments, wherein the one or more retaining feature on each arm are disposed in proximity to a distal end of each arm.

A twelfth embodiment can include the device of any one of the eighth to eleventh embodiments, wherein each arm comprises a plurality of retaining features (e.g. protrusions/teeth or indentations/slots) which are axially spaced.

A thirteenth embodiment can include the device of any one of the ninth to twelfth embodiments, wherein the one or more retaining feature of the wedge are disposed on an exterior surface of the wedge (e.g. face radially outward).

A fourteenth embodiment can include the device of any one of the eighth to thirteenth embodiments, wherein the one or more retaining feature (e.g. teeth or slots) of the arms are disposed on an interior surface of the arms (e.g. face radially inward).

A fifteenth embodiment can include the device of any one of the eighth to fourteenth embodiments, wherein each retaining feature (e.g. protrusion/tooth and/or indentation/slot) comprises a first surface configured for sliding movement (e.g. with respect to the mating retaining feature) axially towards the set position and a second surface configured for interference/overlap (e.g. with respect to the mating retaining feature) to resist movement away from the set position.

A sixteenth embodiment can include the device of any one of the seventh to fifteenth embodiments, wherein the retaining mechanism further comprises a retaining ring (e.g. configured to contact the upper end/face of the slip and/or to remain in positive contact with the slip throughout movement from run-in to set positions and/or to remain in positive contact with the slip at set position) and the plurality of arms extends axially from the retaining ring towards the seal element and/or wedge (e.g. downhole).

A seventeenth embodiment can include the device of the sixteenth embodiment, wherein the retaining ring comprises a bore/opening therethrough.

An eighteenth embodiment can include the device of any one of the first to seventeenth embodiments, wherein the retaining mechanism is configured to provide approximately equal force along circumference of the slip (e.g. on the upper end).

A nineteenth embodiment can include the device of any one of the first to eighteenth embodiments, wherein the retaining mechanism is configured with a locking force (resisting movement away from the set position towards the run-in position) of approximately 750 lbs.

A twentieth embodiment can include the device of any one of the seventh to nineteenth embodiments, wherein each arm extends approximately perpendicular to the ring (e.g. approximately parallel to the longitudinal center axis of the device).

A twenty-first embodiment can include the device of any one of the seventh to twentieth embodiments, wherein the plurality of arms comprises 4-12, 4-6, 6-12, 4-8, 8-12, or 6-8 arms.

A twenty-second embodiment can include the device of any one of the seventh to twenty-first embodiments, wherein the plurality of arms are spaced around a circumference of the ring.

A twenty-third embodiment can include the device of the twenty-second embodiment, wherein the arms are evenly spaced.

A twenty-fourth embodiment can include the device of any one of the first to twenty-third embodiments, wherein in the set position, the retaining mechanism and the wedge form a cage around the slip, for example providing positive contact with the slip to fix both its axial and radial position—e.g. contacting the slip on its upper side/face/end and in proximity to its lower side/face/end (e.g. with the slip held axially between the retaining ring and the wedge and held radially by the arms and/or by press-fit within the wellbore (e.g. against the casing and/or between the casing and the wedge)—e.g. the angled surface of the wedge locks the slip both axially from below and radially from within, the retaining ring locks the slip axially from above, and the arms and/or casing/wellbore locks the slip radially from without).

A twenty-fifth embodiment can include the device of any one of the sixteenth to twenty-fourth embodiments, wherein the retaining ring has an inner diameter no smaller than the ball seat of the slip or wedge and an outer diameter less than the set outer diameter of the seal element (e.g. OD no more than run-in OD of seal element).

A twenty-sixth embodiment can include the device of any one of the first to twenty-fifth embodiments, wherein the slip comprises an axially extending bore and a ball seat (e.g. at the upper end, although in other embodiments the ball seat may be part of the wedge or the retaining ring), and/or wherein the slip further comprises a plurality of teeth/pills configured to dig into the casing/wellbore upon setting).

A twenty-seventh embodiment can include the device of any one of the first to twenty-sixth embodiments, wherein the wedge and seal element each comprise an axially extending bore therethrough.

A twenty-eighth embodiment can include the device of any one of the seventh to twenty-seventh embodiments, wherein the slip comprises a plurality of axially extending slots on its exterior, and wherein the arms of the retaining mechanism are configured to extend axially through the slots.

A twenty-ninth embodiment can include the device of any one of the seventh to twenty-eighth embodiments, wherein the arms extend axially beyond the slip (e.g. towards the seal element and/or downhole).

A thirtieth embodiment can include the device of any one of the twenty-eighth to twenty-ninth embodiments, wherein the number of slots equals the number of arms.

A thirty-first embodiment can include the device of any one of the twenty-eighth to thirtieth embodiments, wherein circumferential spacing of the slots matches the spacing of the arms.

A thirty-second embodiment can include the device of any one of the twenty-eighth to thirty-first embodiments, wherein a width of each arm is less than a width of the corresponding slot.

A thirty-third embodiment can include the device of any one of the seventh to thirty-second embodiments, wherein all of the arms are identical, and wherein all of the slots are identical.

A thirty-fourth embodiment can include the device of any one of the twenty-eighth to thirty-third embodiments, wherein the retaining ring is configured to block/restrict fluid flow axially through/across the slots.

A thirty-fifth embodiment can include the device of any one of the first to thirty-fourth embodiments, wherein the wedge comprises a plurality of wedge elements (e.g. spaced evenly around the circumference of the wedge).

A thirty-sixth embodiment can include the device of the thirty-fifth embodiment, wherein each wedge element comprises an angled surface, and wherein the angled surface is oriented at a wedge angle from the longitudinal axis (of the device and/or wedge).

A thirty-seventh embodiment can include the device of the thirty-sixth embodiment, wherein the wedge angle comprises approximately 100 to 170 degrees.

A thirty-eighth embodiment can include the device of any one of the thirty-fifth to thirty-seventh embodiments, wherein the one or more retaining feature of the wedge are disposed between the wedge elements and/or wherein the one or more retaining feature disposed between the wedge elements are aligned with the slots of the slip and the arms of the retaining mechanism.

A thirty-ninth embodiment can include the device of any one of the thirty-fifth to thirty-eighth embodiments, wherein the one or more retaining feature between adjacent wedge elements comprise a plurality retaining features axially spaced between the adjacent wedge elements.

A fortieth embodiment can include the device of any one of the first to thirty-ninth embodiments, wherein the retaining mechanism is configured for engagement at a plurality of axial locations with respect to the wedge (e.g. to provide for possible usage of the device in a range of casing dimeters).

A forty-first embodiment can include the device of any one of the tenth to fortieth embodiments, wherein the axially spaced wedge retaining features comprise 3-7, 3-5, 5-7, or approximately 5 axially spaced retaining features (e.g. approximately equally spaced).

A forty-second embodiment can include the device of any one of the twelfth to forty-first embodiments, wherein the axially spaced arm retaining feature comprise 3-7, 3-5, 5-7 or approximately 5 axially spaced retaining features (e.g. approximately equally spaced).

A forty-third embodiment can include the device of any one of the first to forty-second embodiments, wherein the retaining mechanism is configured with 5-15, 5-10, 10-15, or approximately 10 axial locations (e.g. possible set positions, for example formed based on the combination/interaction of the axially spaced retaining features of the arms and the axially spaced retaining features of the wedge).

A forty-fourth embodiment can include the device of any one of the first to forty-third embodiments, wherein the retaining mechanism is configured for effective setting within a wellbore/casing/tubular having an inner diameter of approximately 4.670-4.892.

A forty-fifth embodiment can include the device of any one of the first to forty-fourth embodiments, wherein the slip comprises a top slip and the wedge comprises a top wedge, the isolation device further comprising: a bottom slip; and a bottom wedge (e.g. slip prop); wherein the seal element is disposed between the top wedge and bottom wedge.

A forty-sixth embodiment can include the device of the forty-fifth embodiment, wherein the slips (e.g. top and bottom slips), wedges (e.g. top and bottom wedges), and seal element are configured to be disposed around a (e.g. removable) mandrel (e.g. during setting), and wherein the wedges (e.g. the top wedge and the bottom wedge) are configured to be self-supporting after removal of the mandrel (e.g. after setting).

A forty-seventh embodiment can include the device of the forty-sixth embodiment, wherein the device has an approximately uniform inner diameter after removal of the mandrel.

A forty-eighth embodiment can include the device of any one of the first to forty-seventh embodiments, wherein the slip is frangible or dissolvable.

In a forty-ninth embodiment, a system for isolating a zone of a well comprises: the isolation device of any one of the first to forty-eight embodiments; an inner mandrel (e.g. with at least the seal element and wedges initially disposed around the mandrel), wherein the inner mandrel is removable from the zonal isolation device after engagement of the seal element with the inner diameter of the tubing/casing/wellbore).

A fiftieth embodiment can include the system of the forty-ninth embodiment, further comprising a setting sleeve, wherein the setting sleeve is configured for connection to a setting/running tool.

A fifty-first embodiment can include the system of any one of the forty-ninth to fiftieth embodiments, wherein the inner mandrel is configured for connection to a setting/running tool.

A fifty-second embodiment can include the system of any one of the forty-ninth to fifty-first embodiments, further comprising the setting tool.

A fifty-third embodiment can include the system of any one of the forty-ninth to fifty-second embodiments, further comprising a mule shoe, wherein the mule shoe is configured for removable connection to the inner mandrel (e.g. comprises threads for connecting the mule shoe to a bottom end of the inner mandrel (e.g. via threads on the inner mandrel)).

A fifty-fourth embodiment can include the system of the fifty-third embodiment, wherein the attachment/connection of the mule shoe to the mandrel is shearable to allow separation from the mandrel (e.g. by continued application of compression (e.g. using the setting tool) after setting of the isolation device).

A fifty-fifth embodiment can include the system of any one of the forty-ninth to fifty-fourth embodiments, further comprising a ball configured to seat on a ball seat of the isolation device (e.g. on an upper end of the top slip) to restrict fluid flow (e.g. downhole) therethrough (e.g. to plug the ball seat in one direction).

A fifty-sixth embodiment can include the system of any one of the forty-ninth to fifty-fifth embodiments, wherein the device is disposed downhole in a wellbore.

A fifty-seventh embodiment can include the system of any one of the forty-ninth to fifty-sixth embodiments, wherein during run-in, the device is disposed on the mandrel and the outer diameter of the seal element is less than the inner diameter of the wellbore, but upon setting the device has an OD matching the ID of the wellbore.

In a fifth-eighth embodiment, a method of isolating a zone (e.g. of a subterranean formation) of a well, comprises: setting an isolation device at a desired location within a wellbore/tubing string; removing an inner mandrel of the isolation device after setting; and seating a ball onto a ball seat of the isolation device.

A fifty-ninth embodiment can include the method of the fifty-eighth embodiment, wherein the isolation device comprises any one of first to forty-eighth embodiments.

A sixtieth embodiment can include the method of any one of the fifty-eighth to fifty-ninth embodiments, wherein setting an isolation device comprises mechanically actuating a top slip and a bottom slip into engagement with an inner diameter of the wellbore/tubing string; causing axial movement of the top and bottom wedges (e.g. towards each other), wherein the movement causes a seal element disposed between the top and bottom wedges to become engaged with the wellbore/tubing string (e.g. to expand radially outward and into sealing contact with); and fixing/locking/retaining the top slip in a set position.

A sixty-first embodiment can include the method of the sixtieth embodiments, wherein fixing/locking/retaining the top slip comprises forming a cage around the top slip, wherein the top slip is secured between a retaining mechanism and the top wedge (e.g. and the casing/wellbore).

A sixty-second embodiment can include the method of any one of the sixtieth to sixty-first embodiments, wherein fixing/locking/retaining the top slip comprises maintaining positive contact between a retention ring of the retaining mechanism and the slip during movement and/or locking the axial position of the retaining mechanism with respect to the top wedge.

A sixty-third embodiment can include the method of any one of the sixtieth to sixty-second embodiments, wherein mechanically actuating a top slip comprises moving the top slip from a run-in position to a set position (e.g. wherein the set position is axially closer to the seal element of the isolation device than the run-in position, and wherein the run-in position has a smaller OD than the set position).

A sixty-fourth embodiment can include the method of the sixty-third embodiment, wherein in the set position, the top slip is retained both axially and radially (e.g. the axial and radial location of the top slip with respect to the top wedge and/or seal element is fixed/locked).

A sixty-fifth embodiment can include the method of any one of the sixtieth to sixty-fourth embodiments, wherein the retaining element and wedge form a pocket or retaining cage when set.

A sixty-sixth embodiment can include the method of any one of the sixtieth to sixty-fifth embodiments, wherein fixing/locking/retaining the top slip comprises fixing the top slip at one of a plurality of axial locations (e.g. based on the size of the wellbore/casing/tubular).

A sixty-seventh embodiment can include the method of any one of the sixtieth to sixty-sixth embodiments, wherein fixing/locking/retaining the top slip comprises ratcheting the retaining mechanism to the top wedge at the set position, thereby locking the axial position of the top slip between the top wedge and the retaining mechanism.

A sixty-eighth embodiment can include the method of any one of the sixtieth to sixty-seventh embodiments, wherein fixing/locking/retaining the top slip comprises coupling the retaining mechanism to the top wedge at a plurality of evenly spaced circumferential locations (e.g. using the arms).

A sixty-ninth embodiment can include the method of any one of the fifty-eighth to sixty-eighth embodiments, further comprising running the isolation device downhole in a wellbore (e.g. prior to setting).

A seventieth embodiment can include the method of any one of the fifty-eighth to sixty-ninth embodiments, further comprising making up the isolation tool for run-in (e.g. disposing the seal element, top wedge, bottom wedge, top slip, and bottom slip on the mandrel and/or attaching a setting tool and a mule shoe to the mandrel).

A seventy-first embodiment can include the method of the seventieth embodiment, wherein removing the mandrel comprises shearing the mule shoe to disconnect it from the mandrel, and removing the mandrel using the setting tool (e.g. by retracting the setting tool uphole).

A seventy-second embodiment can include the method of any one of the fifty-eighth to seventy-first embodiments, wherein seating the ball comprises pumping the ball downhole (e.g. wherein pumping the ball downhole comprises pumping the ball initially at approximately 30-45 or 30-40 barrels per minute, and slowing the pumping when the ball is in proximity to the isolation device (e.g. slowing to approximately 10-12 barrels per minute)).

A seventy-third embodiment can include the method of any one of the fifty-eighth to seventy-second embodiments, further comprising disposing the isolation device on the mandrel, and attaching the mandrel to the setting/run-in tool.

A seventy-fourth embodiment can include the method of any one of the fifty-eighth to seventy-third embodiments, further comprising pumping fluid (e.g. formation fluid or fracing fluid) (e.g. at a high rate).

A seventy-fifth embodiment can include the method of any one of the fifty-eighth to seventy-fourth embodiments, further comprising producing fluid from the isolated zone of the well (e.g. after setting of the isolation device and/or removal of the mandrel).

In a seventy-sixth embodiment, a retaining cage for locking a slip of an isolation device into set position with respect to a corresponding wedge and/or for preventing dislocation of the set slip, comprises: a retaining ring having an opening; and a plurality of arms extending from the retaining ring (e.g. approximately parallel to the centerline of the opening in the retaining ring and/or approximately parallel to each other); wherein the retaining ring comprises a face configured for positive contact with the slip while the slip moves from a run-in position to the set position and/or a face configured for positive contact with the slip in the set position; and wherein each arm comprises one or more retaining feature configured for mating attachment to a corresponding retaining feature on the wedge, wherein the mating retaining features are configured to provide movement of the slip from the run-in position towards the set position (e.g. when force is applied, for example by a setting tool), but to prevent movement of the slip away from the set position (e.g. to lock the slip in the set position).

A seventy-seventh embodiment can include the retaining cage of the seventy-sixth embodiment, wherein the arms extend axially outward from the face (e.g. configured to extend towards the slip).

A seventy-eighth embodiment can include the retaining cage of any one of the seventy-sixth to seventy-seventh embodiments, wherein the arms are disposed in proximity to the OD of the retaining ring (e.g. the radially outer surface of the arms is flush with the radially outer surface (OD) of the retaining ring).

A seventy-ninth embodiment can include the retaining cage of any one of the seventy-sixth to seventy-eighth embodiments, wherein the arms are configured to extend axially beyond the slip.

An eightieth embodiment can include the retaining cage of any one of the seventy-sixth to seventy-ninth embodiments, wherein each retaining feature comprises a protrusion or an indentation (e.g. tooth or slot) configured to matingly engage a protrusion or indentation (e.g. tooth or slot) of the wedge.

An eighty-first embodiment can include the retaining cage of any one of the seventy-sixth to eightieth embodiments, wherein the one or more retaining feature on each arm are disposed in proximity to a distal end of each arm (e.g. away from the retaining ring).

An eighty-second embodiment can include the retaining cage of any one of the seventy-sixth to eighty-first embodiments, wherein each arm comprises a plurality of retaining features which are axially spaced (e.g. wherein the one or more retaining feature of each arm comprises a plurality of retaining features, which are axially spaced).

An eighty-third embodiment can include the retaining cage of any one of the seventy-sixth to eighty-second embodiments, wherein the one or more retaining feature of each arm are disposed on an interior surface of the arm (e.g. face radially inward).

An eighty-fourth embodiment can include the retaining cage of any one of the seventy-sixth to eighty-third embodiments, wherein each retaining feature comprises a first surface configured for sliding movement (e.g. with respect to the mating retaining feature of the wedge) axially towards the set position and a second surface configured for interference/overlap (e.g. with respect to the mating retaining feature of the wedge) to resist (e.g. axial) movement away from the set position.

An eighty-fifth embodiment can include the retaining cage of any one of the seventy-sixth to eighty-fourth embodiments, wherein the plurality of arms comprises 4-12, 4-6, 6-12, 4-8, 8-12, or 6-8 arms.

An eighty-sixth embodiment can include the retaining cage of any one of the seventy-sixth to eighty-fifth embodiments, wherein the plurality of arms are spaced around a circumference of the ring.

An eighty-seventh embodiment can include the retaining cage of any one of the seventy-sixth to eighty-sixth embodiments, wherein the arms are evenly spaced.

An eighty-eighth embodiment can include the retaining cage of any one of the seventy-sixth to eighty-seventh embodiments, wherein in the set position, the retaining mechanism is configured to interface with the wedge to form a cage around the slip.

An eighty-ninth embodiment can include the retaining cage of any one of the seventy-sixth to eighty-eighth embodiments, wherein the plurality of arms are configured to equal a number of (e.g. axially extending) slots in the corresponding wedge.

A ninetieth embodiment can include the retaining cage of any one of the seventy-sixth to eighty-ninth embodiments, wherein circumferential spacing of the arms is configured to match spacing of the slots in the corresponding wedge.

A ninety-first embodiment can include the retaining cage of any one of the seventy-sixth to ninetieth embodiments, wherein a width of each arm is configured to be less than a width of the corresponding slot in the wedge.

A ninety-second embodiment can include the retaining cage of any one of the seventy-sixth to ninety-first embodiments, wherein all of the arms are substantially identical.

A ninety-third embodiment can include the retaining cage of any one of the seventy-sixth to ninety-second embodiments, wherein the retaining ring is configured to block/restrict fluid flow axially through/across the slots in the wedge (e.g. substantially preventing fluid flow through/across the slots).

A ninety-fourth embodiment can include the retaining cage of any one of the seventy-sixth to ninety-third embodiments, wherein the opening (ID) in the retaining ring is configured to be larger than a ball seat of the corresponding slip and/or wedge.

A ninety-fifth embodiment can include the retaining cage of any one of the seventy-sixth to ninety-fourth embodiments, wherein the OD of the retaining ring is configured to be no more (e.g. typically less) than the OD of the corresponding (e.g. retained) slip in set position (e.g. in some embodiments, the OD of the ring may be approximately the same as the OD of the slip in run-in position).

A ninety-sixth embodiment can include the device of any one of the first to forty-eighth embodiments, wherein the retaining mechanism is configured to prevent dislocation of the slip (e.g. when the slip is set) (e.g. even when fluid is pumped at high rate, such as 30-40 or 30-45 barrels per minute).

While embodiments have been shown and described, modifications thereof can be made by one skilled in the art without departing from the spirit and teachings of this disclosure. The embodiments described herein are exemplary only, and are not intended to be limiting. Many variations and modifications of the embodiments disclosed herein are possible and are within the scope of this disclosure. For example, the various elements or components may be combined or integrated in another system or certain features may be omitted or not implemented. Also, techniques, systems, subsystems, and methods described and illustrated in the various embodiments as discrete or separate may be combined or integrated with other techniques, systems, subsystems, or methods without departing from the scope of this disclosure. Other items shown or discussed as directly coupled or connected or communicating with each other may be indirectly coupled, connected, or communicated with. Method or process steps set forth may be performed in a different order. The use of terms, such as "first," "second," "third" or "fourth" to describe various processes or structures is only used as a shorthand reference to such steps/structures and does not necessarily imply that such steps/structures are performed/formed in that ordered sequence (unless such requirement is clearly stated explicitly in the specification).

Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, R1, and an upper limit, Ru, is disclosed, any number falling within the range is specifically disclosed. In particular, the following numbers within the range are specifically disclosed: R=R1+k*(Ru−R1), wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Language of degree used herein, such as "approximately," "about," "generally," and "substantially," represent a value, amount, or characteristic close to the stated value, amount, or characteristic that still performs a desired function or achieves a desired result. For example, the language of degree may mean a range of values as understood by a person of skill or, otherwise, an amount that is +/−10%.

Use of broader terms such as comprises, includes, having, etc. should be understood to provide support for narrower terms such as consisting of, consisting essentially of, comprised substantially of, etc. When a feature is described as "optional," both embodiments with this feature and embodiments without this feature are disclosed. Similarly, the present disclosure contemplates embodiments where this "optional" feature is required and embodiments where this feature is specifically excluded. The use of the terms such as "high-pressure" and "low-pressure" is intended to only be descriptive of the component and their position within the systems disclosed herein. That is, the use of such terms should not be understood to imply that there is a specific operating pressure or pressure rating for such components. For example, the term "high-pressure" describing a manifold should be understood to refer to a manifold that receives pressurized fluid that has been discharged from a pump irrespective of the actual pressure of the fluid as it leaves the pump or enters the manifold. Similarly, the term "low-pressure" describing a manifold should be understood to refer to a manifold that receives fluid and supplies that fluid to the suction side of the pump irrespective of the actual pressure of the fluid within the low-pressure manifold.

Accordingly, the scope of protection is not limited by the description set out above but is only limited by the claims which follow, that scope including all equivalents of the subject matter of the claims. Each and every claim is incorporated into the specification as embodiments of the present disclosure. Thus, the claims are a further description and are an addition to the embodiments of the present disclosure. The discussion of a reference herein is not an admission that it is prior art, especially any reference that can have a publication date after the priority date of this application. The disclosures of all patents, patent applications, and publications cited herein are hereby incorporated by reference, to the extent that they provide exemplary, procedural, or other details supplementary to those set forth herein.

Use of the phrase "at least one of" preceding a list with the conjunction "and" should not be treated as an exclusive list and should not be construed as a list of categories with one item from each category, unless specifically stated otherwise. A clause that recites "at least one of A, B, and C" can be infringed with only one of the listed items, multiple of the listed items, and one or more of the items in the list and another item not listed.

As used herein, the term "or" is inclusive unless otherwise explicitly noted. Thus, the phrase "at least one of A, B, or C" is satisfied by any element from the set {A, B, C} or any combination thereof, including multiples of any element.

As used herein, the term "and/or" includes any combination of the elements associated with the "and/or" term. Thus, the phrase "A, B, and/or C" includes any of A alone, B alone, C alone, A and B together, B and C together, A and C together, or A, B, and C together.

The invention claimed is:

1. An isolation device for use downhole in a wellbore, comprising:

a slip;

a wedge, wherein the slip has a run-in position with respect to the wedge and a set position with respect to the wedge;

a seal element configured to expand radially as the slip transitions from the run-in position to the set position; and a retaining mechanism configured to allow movement of the slip from the run-in position towards the set position, but to lock the slip in the set position, wherein:

the retaining mechanism comprises a first retaining element and a second retaining element, wherein the first and second retaining elements are configured to matingly engage to allow movement of the slip from the run-in position towards the set position, but to prevent movement of the slip away from the set position;

the retaining mechanism comprises a plurality of axially extending arms;

the first retaining element comprises one or more retaining feature on each arm;

the second retaining element comprises one or more retaining feature on the wedge, the retaining mechanism further comprises a retaining ring, and the plurality of arms extend axially from the retaining ring towards the seal element; and the slip comprises an exterior surface and a plurality of axially extending slots on the exterior surface, wherein the arms of the retaining mechanism are configured to extend axially through the slots, and wherein the arms extend axially beyond the slip.

2. The isolation device of claim 1, wherein the one or more retaining feature of the wedge comprises a plurality of retaining features which are axially spaced, or the one or more retaining feature of each arm comprises a plurality of retaining features which are axially spaced.

3. The isolation device of claim 1, wherein the one or more retaining feature of the wedge are disposed on an exterior surface of the wedge, and wherein the one or more retaining feature of the arms are disposed on an interior surface of the arms.

4. The isolation device of claim 1, wherein each retaining feature comprises a first surface configured for sliding movement, with respect to the mating retaining feature, axially towards the set position, and a second surface configured for interference, with respect to the mating retaining feature, to resist movement away from the set position.

5. The isolation device of claim 1, wherein in the set position, the retaining mechanism and the wedge form a cage around the slip.

6. The isolation device of claim 1, wherein the retaining ring is configured to restrict fluid flow axially through the slots in the set position.

7. The isolation device of claim 6, wherein the retaining ring has an inner diameter no smaller than a ball seat of the slip or the wedge.

8. The isolation device of claim 7, wherein:

the wedge comprises a plurality of wedge elements;

each wedge element comprises an angled surface oriented at a wedge angle from a longitudinal axis of the device;

the wedge angle comprises approximately 100 to 170 degrees; and the one or more retaining feature of the wedge are disposed between the wedge elements.

9. The isolation device of claim 1, wherein the slip comprises a top slip and the wedge comprises a top wedge, the isolation device further comprising:

a bottom slip; and a bottom wedge;

wherein the seal element is disposed between the top wedge and bottom wedge.

10. The isolation device of claim 9, wherein the top and bottom slips, the top and bottom wedges, and the seal element are configured to be disposed around a removable mandrel during setting, and wherein the top wedge and the bottom wedge are configured to be self-supporting after removal of the mandrel.

11. A system of isolating a zone of a well, comprising:

the isolation device of claim 10;

a mandrel, wherein the mandrel is configured for connection to a setting tool and wherein the mandrel is removable from the isolation device after engagement of the seal element with an inner diameter of the wellbore; and a mule shoe, wherein the mule shoe is configured for removable connection to the mandrel; wherein the connection of the mule shoe to the mandrel is shearable to separate from the mandrel.

12. The system of claim 11, further comprising a ball configured to seat on a ball seat of the isolation device to restrict fluid flow therethrough.

13. The system of claim 11, further comprising a setting tool; wherein the mandrel is attached to a downhole end of the setting tool, and wherein the isolation device is disposed downhole in a wellbore of the well.

14. A method of isolating a zone of a well, comprising:

setting the isolation device of claim 10 at a desired location within a wellbore of the well;

removing the inner mandrel of the isolation device after setting; and seating a ball onto a ball seat of the isolation device; wherein setting the isolation device comprises:

mechanically actuating the top slip and the bottom slip into engagement with an inner diameter of the wellbore;

causing axial movement of the top and bottom wedges, wherein the movement causes the seal element disposed between the top and bottom wedges to become engaged with the wellbore; and fixing the top slip in a set position with the retaining mechanism.

15. The method of claim 14, wherein fixing the top slip in a set position comprises forming a cage around the top slip, wherein the top slip is secured between the retaining mechanism, the top wedge, and the wellbore.

16. The method of claim 14, wherein fixing the top slip in a set position comprises maintaining positive contact between the retaining ring of the retaining mechanism and the top slip during the movement.

17. The method of claim 14, wherein fixing the top slip in a set position comprises fixing the top slip at one of a plurality of axial locations.

18. The method of claim 14, wherein fixing the top slip in a set position comprises coupling the retaining mechanism to the top wedge at a plurality of evenly spaced circumferential locations, wherein the top slip is secured between the retaining mechanism and the top wedge to prevent dislocation of the top slip when set.

19. The method of claim 14, wherein seating the ball comprises pumping the ball downhole initially at approximately 30-45 barrels per minute, and then slowing the pumping to approximately 10-12 barrels per minute as the ball is in proximity to the isolation device.

20. The method of claim 14, wherein fixing the top slip in a set position further comprises restricting fluid flow axially through the slots using the retaining ring.

* * * * *